US011236501B2

(12) United States Patent
Boyd et al.

(10) Patent No.: US 11,236,501 B2
(45) Date of Patent: Feb. 1, 2022

(54) FULL MOMENT CONNECTION COLLAR SYSTEMS

(71) Applicant: ConXtech, Inc., Pleasanton, CA (US)

(72) Inventors: John S. Boyd, Tiburon, CA (US); Kevin Marek, Hayward, CA (US); Eric Bellman, Hayward, CA (US); Maxwell C. Simmons, Hayward, CA (US); Robert J. Simmons, Hayward, CA (US); Brian Hood, San Francisco, CA (US)

(73) Assignee: ConXtech, Inc., Pleasanton, CA (US)

( * ) Notice: Subject to any disclaimer, the term of this patent is extended or adjusted under 35 U.S.C. 154(b) by 154 days.

(21) Appl. No.: 16/270,571

(22) Filed: Feb. 7, 2019

(65) Prior Publication Data

US 2019/0249409 A1 Aug. 15, 2019

Related U.S. Application Data

(60) Provisional application No. 62/628,807, filed on Feb. 9, 2018.

(51) Int. Cl.

| | |
|---|---|
| ***E04H 12/00*** | (2006.01) |
| ***E04B 1/19*** | (2006.01) |
| ***E04B 1/24*** | (2006.01) |

(52) U.S. Cl.

CPC ..... *E04B 1/1912* (2013.01); *E04B 1/24* (2013.01); *E04B 2001/1915* (2013.01)

(58) Field of Classification Search

CPC .. E04B 1/24; E04B 1/1912; E04B 2001/2424; E04B 2001/2454; E04B 2001/2415; E04B 2001/1915

(Continued)

(56) References Cited

U.S. PATENT DOCUMENTS

| | | | |
|---|---|---|---|
| 925,677 | A | 6/1909 | Belcher |
| 1,400,066 | A | 12/1921 | Huck |

(Continued)

FOREIGN PATENT DOCUMENTS

| | | | |
|---|---|---|---|
| EP | 3162976 | A1 | 5/2017 |
| FR | 1514258 | A | 2/1968 |

(Continued)

OTHER PUBLICATIONS

European Patent Office, Supplementary European Search Report in European Patent Application No. 01968363.0, dated Mar. 27, 2007, 3 pages.

(Continued)

*Primary Examiner* — Todd M Epps
(74) *Attorney, Agent, or Firm* — Kolisch Hartwell, P.C.

(57) ABSTRACT

A full-moment column collar is disclosed, including four collar flange components and four collar corner components. Each collar flange component includes an upper transverse element and a lower transverse element, connected by a bridging member. Each collar corner component includes first and second expanses defining a corner and a standoff portion extending from the corner, the standoff portion having a distal T-shaped structure. Each collar corner component is configured to connect two adjacent collar flange components, and each collar corner component has a multi-axis alignment structure extending from a bottom end portion for vertically positioning a lower transverse element of a respective collar flange component.

20 Claims, 10 Drawing Sheets

(58) Field of Classification Search
USPC ..... 248/219.4; 52/655.1, 854
See application file for complete search history.

(56) References Cited

U.S. PATENT DOCUMENTS

| | | | | |
|---|---|---|---|---|
| 1,729,743 | A | 10/1929 | Jorgensen et al. | |
| 2,008,087 | A | 7/1935 | Stromberg | |
| 3,148,477 | A | 9/1964 | Bjorn et al. | |
| 3,289,999 | A | 12/1966 | Konzak | |
| 3,396,499 | A | 8/1968 | Biffani | |
| 3,410,044 | A | 11/1968 | Moog | |
| 3,562,988 | A | 2/1971 | Gregoire | |
| 3,664,011 | A | 5/1972 | Labastrou | |
| 3,685,866 | A | 8/1972 | Patenaude | |
| 3,706,169 | A | 12/1972 | Rensch | |
| 3,829,999 | A | 8/1974 | Bernstein | |
| 3,977,801 | A | 8/1976 | Murphy | |
| 4,019,298 | A | 4/1977 | Johnson, IV | |
| 4,018,057 | A | 8/1977 | Erzen et al. | |
| 4,577,449 | A | 3/1986 | Celli | |
| 4,684,285 | A | 8/1987 | Cable | |
| 4,742,665 | A | 5/1988 | Baierl | |
| 4,905,436 | A | 3/1990 | Matsuo et al. | |
| 5,061,111 | A | 10/1991 | Hosokawa | |
| 5,240,089 | A | 8/1993 | Spera | |
| 5,244,300 | A | 9/1993 | Perreira et al. | |
| 5,289,665 | A | 3/1994 | Higgins | |
| 5,342,138 | A | 8/1994 | Saito et al. | |
| 5,590,974 | A | 1/1997 | Yang | |
| 5,605,410 | A | 2/1997 | Pantev | |
| 5,678,375 | A | 10/1997 | Juola | |
| 6,082,070 | A | 7/2000 | Jen | |
| 6,092,347 | A | 7/2000 | Hou | |
| 6,106,186 | A | 8/2000 | Taipale et al. | |
| 6,219,989 | B1 | 4/2001 | Tumura | |
| 6,390,719 | B1 | 5/2002 | Chan | |
| 6,802,169 | B2 | 10/2004 | Simmons | |
| 6,837,016 | B2 | 1/2005 | Simmons et al. | |
| 7,021,020 | B2 | 4/2006 | Simmons et al. | |
| 7,941,985 | B2 * | 5/2011 | Simmons | E04B 1/24 52/655.1 |
| 8,453,414 | B2 | 6/2013 | Simmons | |
| 8,745,954 | B2 | 6/2014 | Simmons | |
| 8,782,994 | B1 | 6/2014 | Simmons | |
| 10,876,282 | B1 * | 12/2020 | Mou | E04B 1/2604 |
| 10,907,343 | B1 * | 2/2021 | Mou | E04B 1/30 |
| 10,954,663 | B2 * | 3/2021 | Mou | E04B 1/58 |
| 10,961,696 | B2 * | 3/2021 | Mou | E04B 1/2403 |
| 2003/0041549 | A1 * | 3/2003 | Simmons | E04B 1/2403 52/655.1 |
| 2004/0139683 | A1 | 7/2004 | Simmons | |
| 2005/0055954 | A1 * | 3/2005 | Simmons | E04B 1/26 52/633 |
| 2006/0110215 | A1 | 5/2006 | Holscher | |
| 2008/0178551 | A1 | 7/2008 | Porter | |
| 2008/0295443 | A1 * | 12/2008 | Simmons | E04B 1/24 52/655.1 |
| 2014/0026514 | A1 | 1/2014 | Davis et al. | |
| 2017/0314254 | A1 | 11/2017 | Houghton et al. | |

FOREIGN PATENT DOCUMENTS

| | | | |
|---|---|---|---|
| FR | 2471461 | A1 | 6/1981 |
| FR | 2613403 | A1 | 10/1988 |
| GB | 1204327 | A | 9/1970 |
| JP | 06081394 | A | 3/1994 |
| JP | 07150635 | A | 6/1995 |
| JP | 08144370 | A | 6/1996 |
| JP | 2011-22001 | A | 1/1999 |
| JP | 2000-110236 | A | 4/2000 |
| JP | 2004011377 | A | 1/2004 |
| WO | 9836134 | A1 | 8/1998 |
| WO | 03021061 | A1 | 3/2003 |
| WO | 2008150433 | A1 | 12/2008 |
| WO | 2018039717 | A1 | 8/2018 |
| WO | 2019157237 | A1 | 8/2019 |

OTHER PUBLICATIONS

European Patent Office, Communication Pursuant to Article 94(3) EPC in European Patent Application No. 01968363.0, dated Jun. 10, 2010, 5 pages.
U.S. Patent and Trademark Office, Non-Final Office Action in U.S. Appl. No. 12/156,252, dated Sep. 14, 2010, 12 pages.
European Patent Office, Extended European Search Report in European Patent Application No. 08767946.0, dated Jan. 17, 2014, 7 pages.
European Patent Office, Communication Pursuant to Article 94(3) EPC in EP Patent Application No. 08767946.0, dated Jun. 10, 2015, 5 pages.
European Patent Office, Communication Pursuant to Article 94(3) EPC in European Patent Application No. 01968363.0, dated Jan. 7, 2016, 5 pages.
European Patent Office, Extended European Search Report in European Patent Application No. 16189759.0, dated May 4, 2017, 9 pages.
European Patent Office, Communication Pursuant to Article 94(3) EPC in EP Patent Application No. 16189759.0, dated Jul. 10, 2018, 6 pages.
European Patent Office, Communication Pursuant to Article 94(3) EPC in EP Patent Application No. 16189759.0, dated Apr. 25, 2019, 4 pages.
The U.S. Receiving Office of WIPO, International Search Report and Written Opinion of the International Searching Authority regarding PCT Application No. PCT/US2019/017138, dated Jun. 5, 2019, 20 pages.
The International Bureau of WIPO, International Preliminary Report on Patentability regarding PCT Application No. PCT/US2019/017138, dated Aug. 20, 2020, 8 pages.

* cited by examiner

FULL MOMENT CONNECTION COLLAR SYSTEMS

CROSS-REFERENCES

This application claims the benefit under 35 U.S.C. § 119(e) of the priority of U.S. Provisional Patent Application Ser. No. 62/628,807, filed Feb. 9, 2018, the entirety of which is hereby incorporated by reference for all purposes. U.S. Pat. No. 7,941,985 B2 is also incorporated by reference herein, in its entirety, for all purposes.

INTRODUCTION

Steel frame building construction requires connection of beams and columns, and moment resisting connections are needed for continuous frames. Full moment connection systems such as collar mounts offer valuable improvements over on-site welding techniques. Welding can be done off-site in controlled conditions, frame members are seated in the proper spatial orientation when connected by a collar, and on-site construction may be carried out more quickly, safely, and efficiently.

U.S. Pat. No. 7,941,985 B2 discloses an exemplary full moment collar mount, described as a halo/spider connection. Where a beam and a column connect, a collar flange assembly is welded to the end of the beam. Two collar corners are welded to corners on either side of a face of the column. To connect, the beam is lowered so that the flange assembly is received between the collar corners, which form a tapered channel. Connections on all faces of the column together form a full moment collar.

SUMMARY

The present disclosure provides systems, apparatuses, and methods relating to full moment connections. In some examples, a full moment column collar may include four collar flange assemblies and four collar corner assemblies. Each collar flange assembly may include an upper transverse element and a lower transverse element, connected by a bridging member. Each collar corner assembly may include first and second expanses defining a corner and a standoff portion extending from the corner, the standoff portion having a distal T-shaped structure. Each collar corner assembly may be configured to connect two adjacent collar flange assemblies, and each collar corner assembly may have a multi-axis alignment structure extending from a bottom end portion for vertically positioning a lower transverse element of a respective collar flange assembly.

In some examples, a method of manufacturing a full moment column collar may include molding a collar flange blank. The method may further include machining a beam docking structure in the collar flange blank, corresponding to a selected I-beam flange dimension. The beam docking structure may include a seat configured to contact and !-beam flange.

In some examples, a method of manufacturing a full moment column collar may include molding a collar corner blank having first and second expanses defining a corner and a standoff extending from the corner. The standoff may have a distal T-shaped structure. The method may further include machining a stop surface on the collar corner blank, configured to contact a surface on a collar flange assembly.

Features, functions, and advantages may be achieved independently in various examples of the present disclosure, or may be combined in yet other examples, further details of which can be seen with reference to the following description and drawings.

DETAILED DESCRIPTION

Figure 1:
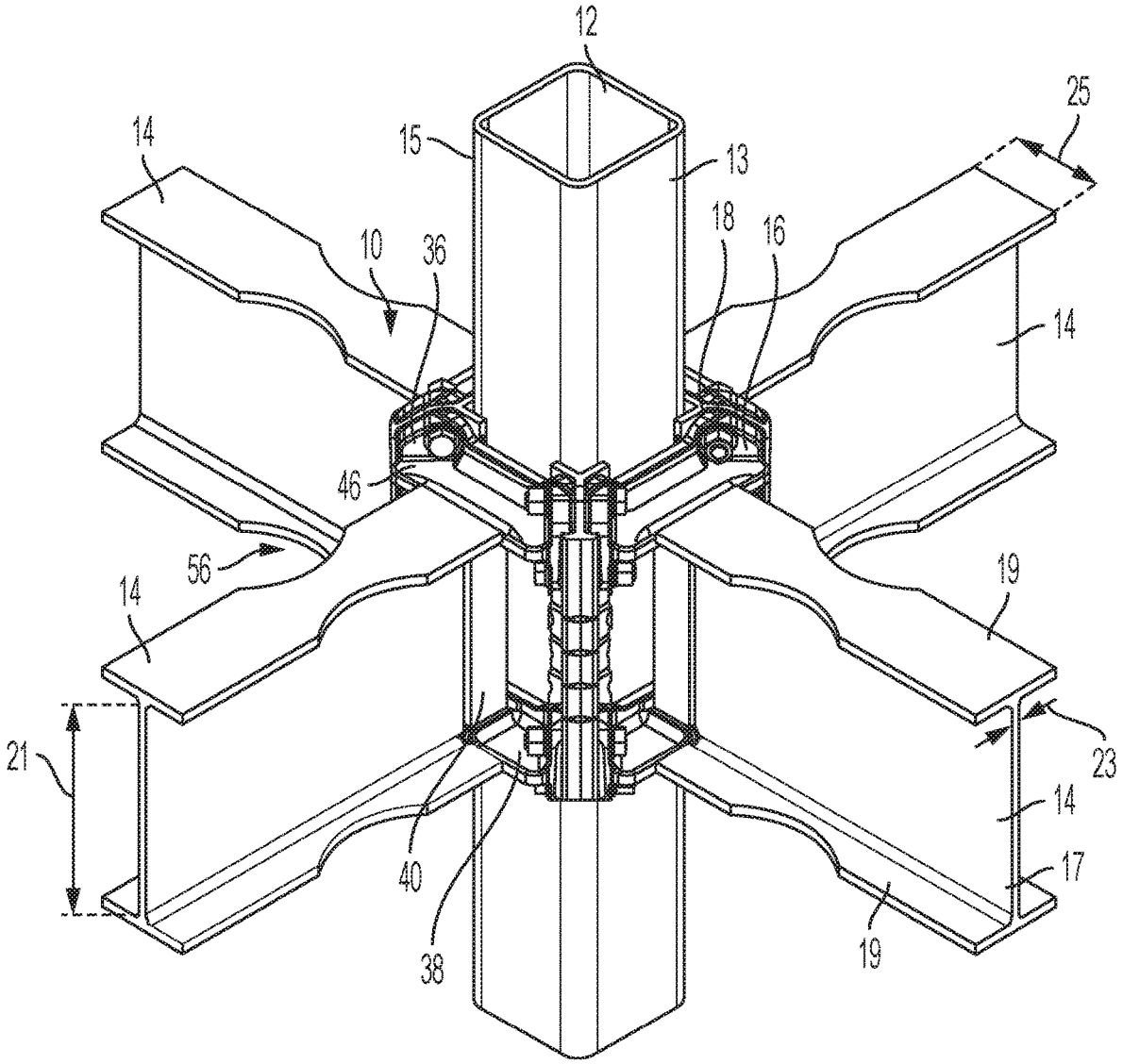
FIG. 1 is an isometric view of an illustrative full-moment column collar in accordance with aspects of the present disclosure, connecting a column and four I-beams.

Various aspects and examples of a full-moment connection collar system, as well as related methods, are described below and illustrated in the associated drawings. Unless otherwise specified, a connection system in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2)

Examples, Components, and Alternatives; (3) Illustrative Combinations and Additional Examples; (4) Advantages, Features, and Benefits; and (5) Conclusion. The Examples, Components, and Alternatives section is further divided into subsections A to C, each of which is labeled accordingly.

Overview

In general, a full-moment collar connection system may connect one or more lateral members to a vertical member. For instance, the full moment collar connection system may connect a square box column and four I-beams. The connection system may also be configured to connect other types of structural members.

The connection system includes a collar, which surrounds a portion of the vertical member. The collar may include a first plurality of components and a second plurality components. The first plurality of components may be fixed to the vertical member, and may be referred to as standoffs, column-connectors, and/or collar corner assemblies. One or more of the second plurality of components may each be fixed to a corresponding lateral member, and the components may be referred to as spans, beam-connectors, and/or collar flange assemblies.

Components of the first and second pluralities may be fastened together, for instance may be bolted together. The components of the collar may be configured to connect in a precise spatial configuration. Correct spatial configuration of the collar may allow precise and accurate orientation of the lateral members relative to each other and relative to the vertical member. Such orientation may be important to successful building of larger structures, such as a building frame. By locating the collar components relative to one another, a desired spatial configuration of the collar may be achieved largely independently of variations in the specifications of the lateral members and vertical member.

Components of the collar may be manufactured by molding a blank and machining selected features. Molding of the blanks may limit production cost, allowing precise machining to be used only for those features important to achieving the desired spatial configuration. Such manufacturing may also allow storage of a standard blank, and on-demand machining according to the dimensions of a selected lateral member.

Examples, Components, and Alternatives

The following sections describe selected aspects of exemplary full-moment connection collars as well as related systems and/or methods. The examples in these sections are intended for illustration and should not be interpreted as limiting the entire scope of the present disclosure. Each section may include one or more distinct examples, and/or contextual or related information, function, and/or structure.

A. Illustrative Full-Moment Column Collar

As shown in FIGS. 1-10, this section describes an illustrative collar 10. Collar 10 is an example of a full-moment collar connection system, as described above. In FIG. 1, collar 10 is shown connecting a square box column 12 and four I-beams 14 of a building frame. The location of the connection on the column may be referred to as a node. In some examples, one column may include multiple nodes, each connected to one or more beams by a collar.

As shown in FIG. 1, collar 10 connects beams 14 to column 12 such that opposing beams are parallel and adjacent beams are orthogonal, with all the beams orthogonal to the column. In some examples, the beams may be substantially orthogonal within some angular tolerance or may form other angles with adjacent beams and/or with the column. Precise location and orientation of the beams relative to the column is achieved by engagement between components of the collar.

Column 12 includes four sides or faces 13 and four corners 15. Each beam 14 is mounted proximate a corresponding face 13 of the column. Each beam 14 includes a web 17 spanning between upper and lower beam flanges 19. Web 17 has a thickness 23 and a height 21, which is typically referred to as a beam depth of beam 14. Upper and lower beam flanges 19 each have a width 25. Beam depth 21, web thickness 23, and flange width 25 may all vary with beam weight and size. Collar 10 may be configured according to the dimensions of column 12 and beams 14. Collar 10 may be configured to connect four beams of matching dimensions, or beams of differing dimensions.

Collar 10 includes equal numbers of flange assemblies 16 and corner assemblies 18. In the present example, for a column with four faces, the collar includes four flange assemblies and four corner assemblies. The flange assemblies and corner assemblies alternate, such that each corner assembly engages two flange assemblies, and similarly each flange assembly engages two corner assemblies. Each corner assembly 18 is welded to one of corners 15 of column 12. In the present example, each flange assembly 16 is welded to one of beams 14. In some examples, fewer than four beams may be connected to the column and up to three flange assemblies may remain un-welded to a beam. In some examples, other structures or structural members may be connected to one or more flange assemblies. For instance, a converter for a gravity catch connection may be welded to a flange assembly.

Figure 2:
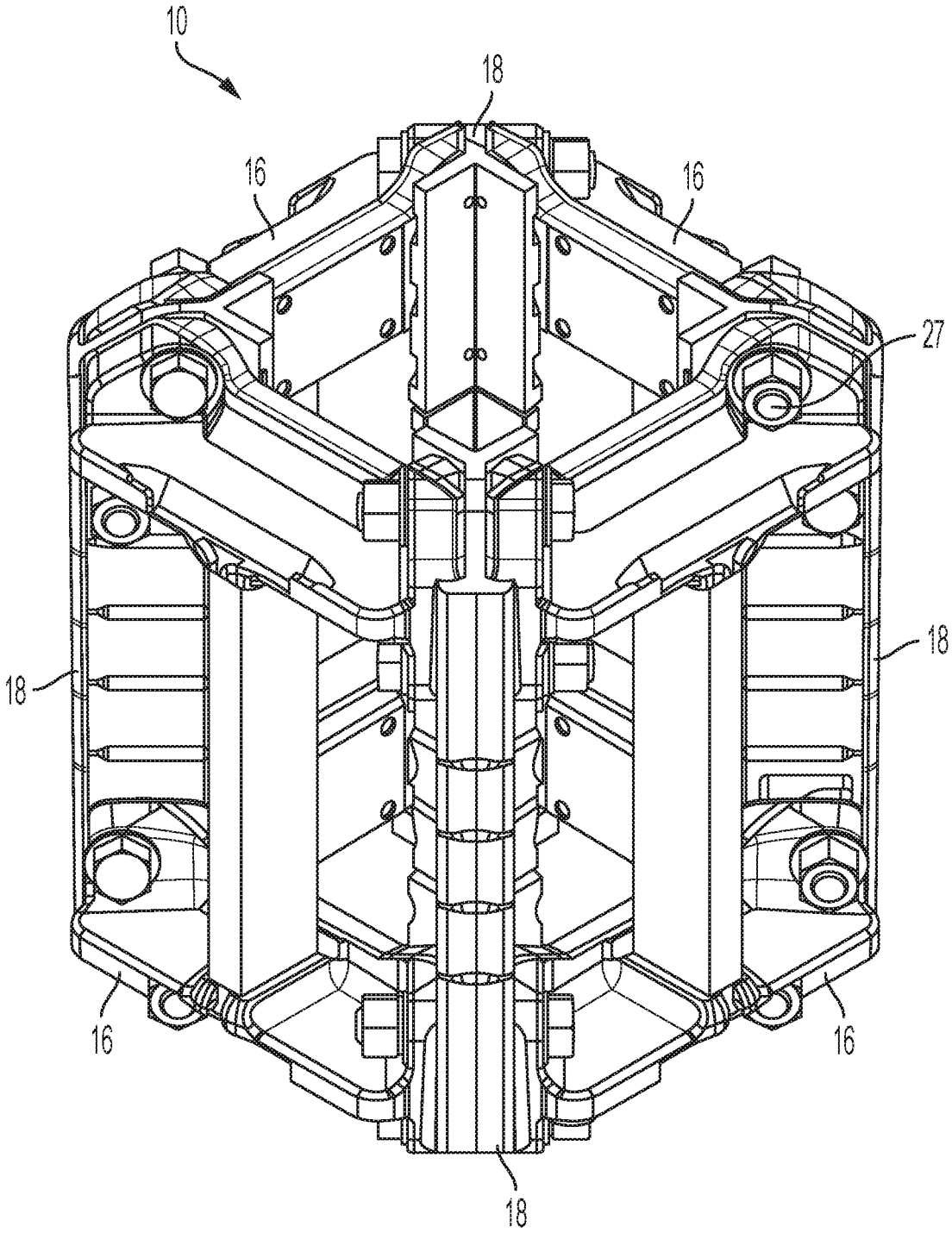
FIG. 2 is an isometric view of the collar of FIG. 1.

As shown in FIG. 2, flange assemblies and corner assemblies are fastened together by horizontal bolts 27 extending through corresponding holes in the assemblies. Each bolt 27 extends through two flange assemblies and a corner assembly. Each corner assembly is fastened by only four bolts, and collar 10 is fastened by a total of only sixteen bolts.

Collar 10 includes a gravity stop feature, such that a beam with a mounted flange assembly can be lowered into engagement with two corner assemblies on the column and can be supported by the gravity stop feature while the assemblies are bolted together. The gravity stop may also be referred to as an alignment guide, and may be configured to guide a flange assembly to a precise vertical and horizontal position. For example, the gravity stop may include curved or sloped surfaces. The gravity stop may also help to correctly position each adjacent flange assembly and corner assembly relative to one another, align corresponding holes in the assemblies, and position each assembly relative to the collar as a whole.

Each assembly may comprise multiple components, welded together. Each component may be produced from a molded blank. For instance, blanks may be cast, forged, extruded, or additively manufactured. Selected features may be machined into the blank to form an assembly component. The features selected may be those responsible for determining spatial location and orientation of the assembly when connected in collar 10. For instance, bolt holes and engaging features may be selected to assure precise engagement. The machined surfaces of the selected features may be referred to as datum surfaces.

Figure 3:
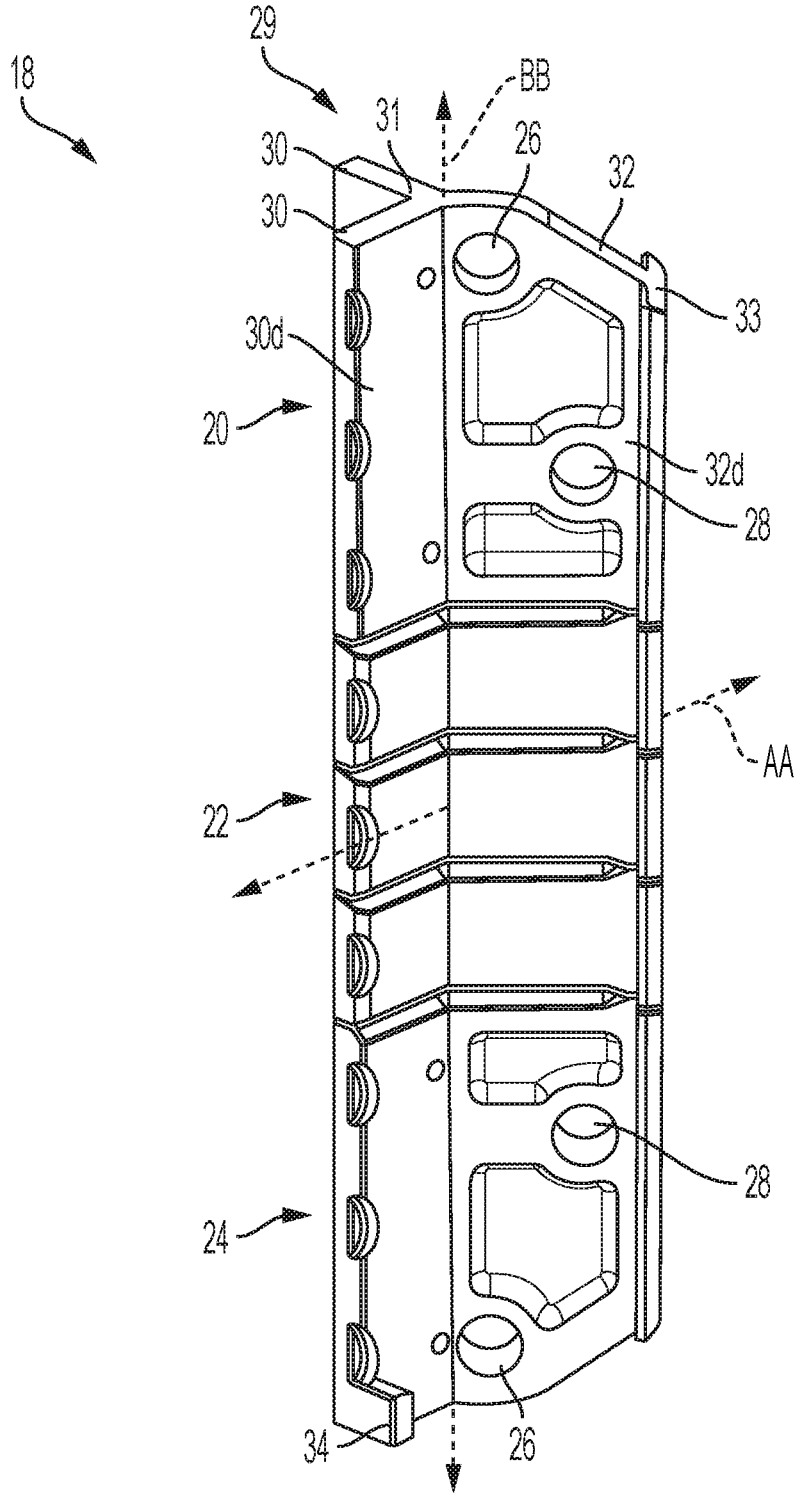
FIG. 3 is an isometric view of a corner assembly of the collar of FIG. 2.

FIG. 3 is a more detailed view of a corner assembly 18. Corner assembly 18 includes a column mating portion 29 having first and second expanses 30. The expanses extend the length of the assembly and define a corner or intersection 31. The expanses, which may also be referred to as feet, form an interior angle at the intersection, which corresponds to column 12 (See FIG. 1). In the present example column 12 has a square cross-section, and the interior angle is a right angle.

Each foot 30 is configured for mounting on a face of the column, such that the corner assembly spans a corner of the column. A standoff 32 extends from intersection 31, oriented generally parallel to a bisector of the interior angle of the feet. A standoff-facing side of each foot 30 may be a primary datum surface 30*d* of corner assembly 18. Each side surface of the standoff may also be a datum surface 32*d*. Standoff 32 also includes a T-shaped structure 33, distal from intersection 31.

In the present example, corner assembly 18 is comprised of a top section 20, a middle section 22, and a bottom section 24. Each section may be machined from a separate blank. Sections 20, 22, and 24 are welded together to form the corner assembly. Top section 20 and bottom section 24 are generally matching, but mirrored. Each includes two bolt holes, an outer bolt hole 26 and an inner bolt hole 28. The bolt holes are located to correspond to holes in the flange assemblies.

Outer bolt hole 26 and inner bolt hole 28 of top section 20 and bottom section 24 extend through standoff 32. Each of the top and bottom sections includes an inner portion of standoff 32 that is adjacent to middle section 22 and an outer portion of the standoff that is distant from the middle section. Each outer bolt hole 26 is disposed in the outer portion, proximal to intersection 31. Each inner bolt hole 28 is disposed in the inner portion, and in the present example is distal from intersection 31. Holes 26, 28 may be described as aligned along a line oblique to an elongate axis BB of the corner assembly.

Figure 6:
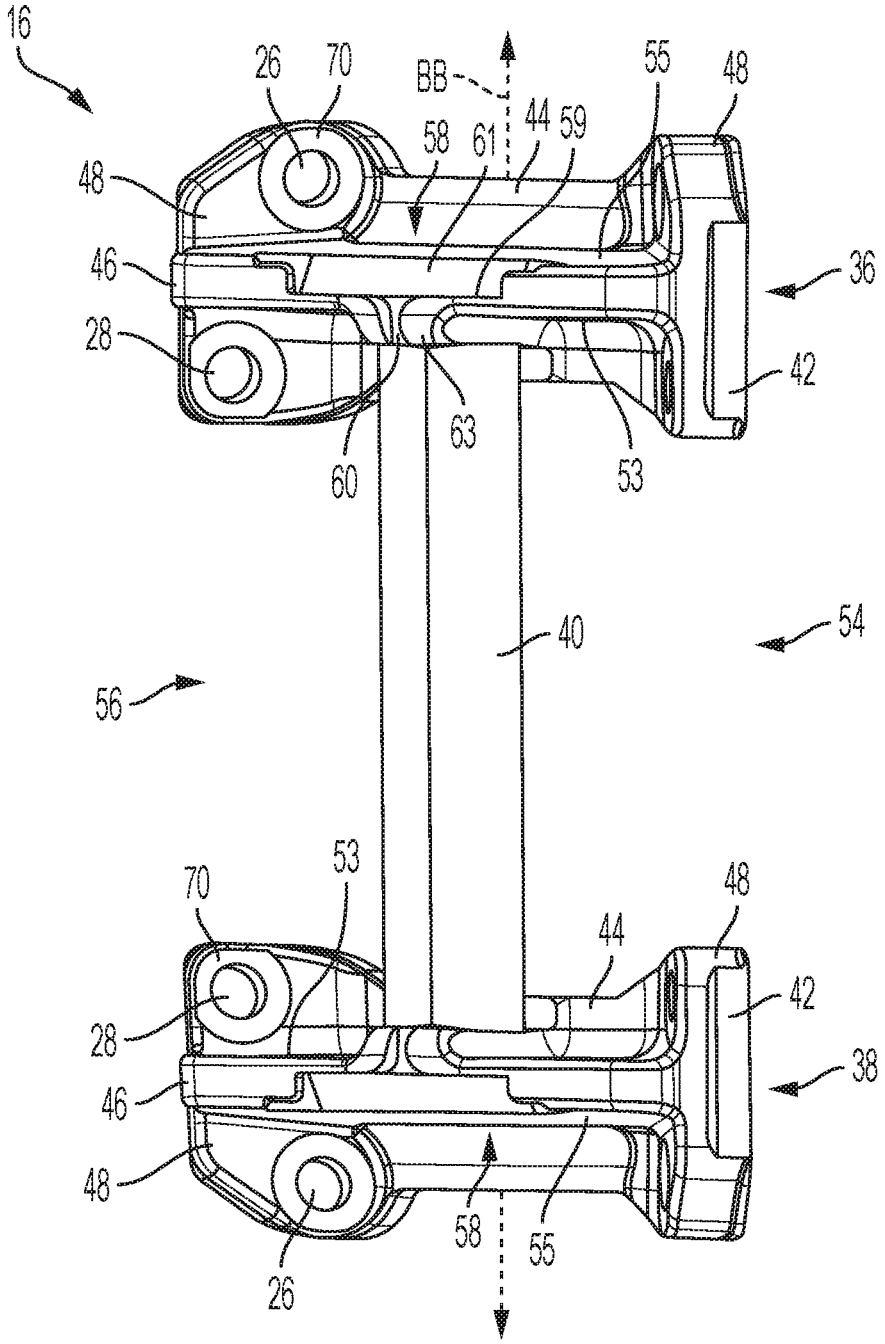
FIG. 6 is an isometric view of a flange assembly of the collar of FIG. 2.
Figure 7:
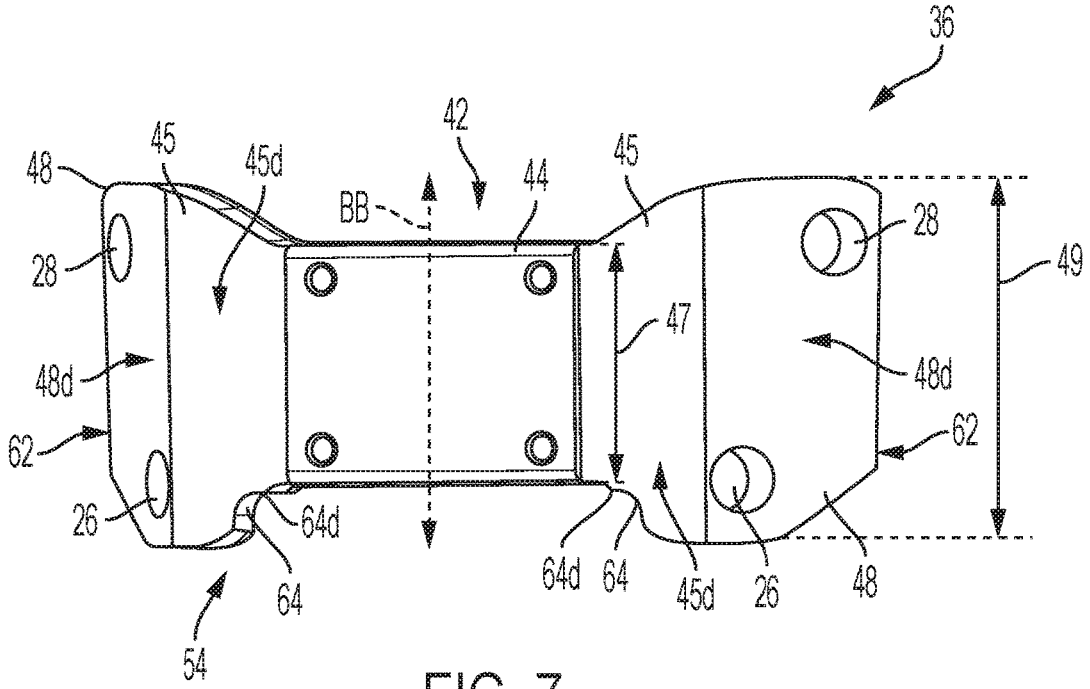
FIG. 7 is a front view of the bottom transverse element of the flange assembly of FIG. 6.

The location of outer bolt hole 26 may reduce the mechanical advantage of bending loads from beams connected to the collar, as described further with reference to flange assembly 16 and FIGS. 6 and 7. Such placement thereby allows use of only two bolts at each top and bottom section, simplifying connection of the collar while maintaining connection strength.

Along top section 20 and bottom section 24, the height of standoff 32 may vary. That is, the distance between T-shaped structure 33 and intersection 31 may vary. A channel formed between a foot 30 and T-shaped structure 33 of the standoff may therefore taper over the length of corner assembly 18. Note that in FIG. 3, the taper is difficult to distinguish due to the small taper angle. T-shaped structure 33 is more clearly shown in FIG. 4.

Top section 20 and bottom section 24 are a standard size, but middle section 22 is selectable from a range of sizes. In the present example, middle section 22 is composed of multiple identical pieces, welded together. The number of pieces included in the middle section can be varied according to a desired length of corner assembly 18. The length of corner assembly 18 may be selected to correspond to a selected flange assembly size or beam depth. In examples for which a minimum size of corner assembly 18 is desired, middle section 22 may be omitted.

Figure 4:
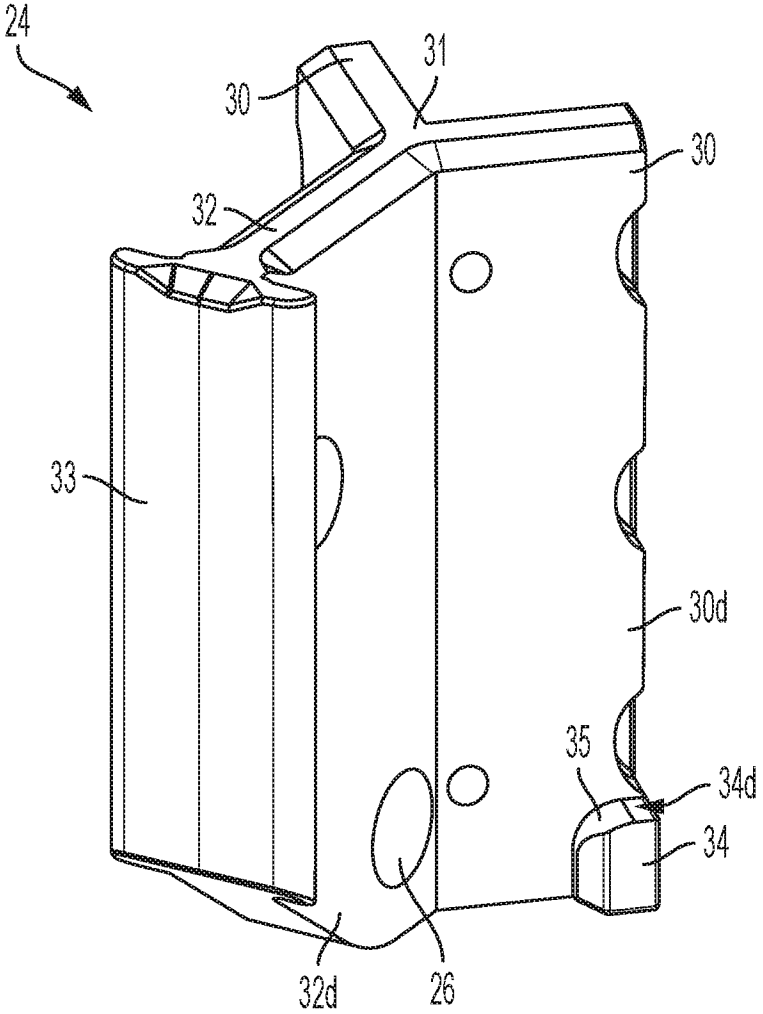
FIG. 4 is an isometric view of a bottom section of the corner assembly of FIG. 3.

As shown in more detail in FIG. 4, each foot 30 of bottom section 24 includes a multi-axis alignment structure 34 at a bottom end. The structure is distal from intersection 31 on foot 30. Alignment structure 34 is configured to position a flange assembly along two axes, a vertical and a horizontal axis. For example, the alignment structure may position the flange assembly with respect to axes AA and BB, shown in FIG. 3. For another example, the alignment structure may position the flange assembly along a column axis and a beam axis, as defined by column 12 and an adjacent beam 14, shown in FIG. 1.

Referring again to FIG. 4, alignment structure 34 is configured to act as a gravity stop, to support a flange assembly, and to precisely position the assembly in a vertical or Z-axis direction. Secondly, the alignment structure is configured to act as a guide, to engage a flange assembly, and to precisely position the assembly in a horizontal or X-axis direction. The channel defined between foot 30 and t-shaped structure 33 is similarly configured to precisely locate an engaged flange assembly in a horizontal or lateral plane. The alignment and guide functions of alignment structure 34 are discussed in greater detail with reference to FIG. 10, below.

Structure 34 has a planar top face 34*d* that precisely locates a supported flange assembly along the vertical or column axis. Structure 34 also includes a curved upper surface 35 or guiding shoulder configured to engage a complementary bottom surface of a flange assembly. Upper surface 35 may be described as a graduated surface descending from planar top face 34*d*. Alignment structure 34 may also be described as having a planar horizontal face 34*d* connect to a vertical planar face by a sloping and/or sloped face 35. The sloped face may be planar or curved as in the present example. Preferably the sloped face may have an average slope in a range of approximately 15 to 45 degrees.

Alignment structure 34 may be configured for effective load transfer to foot 30. For example, the structure may be of sufficient size and/or sufficient cross-sectional dimension to withstand loads applied by a flange assembly. Alignment structure 34 is molded as part of the blank for bottom section 24, which may confer additional structural strength. Planar top face 34 and curved upper surface 35 may each be machined from the molded structure.

Corner assembly 18 is configured to limit weight by omitting material unnecessary to structural strength. For this reason, top section 20 and bottom section 24 have curved outer profiles and include recesses in standoff 32. Similarly, feet 30 include cutouts at the edge to reduce material. As noted below, such shaping may improve a strength to weight ratio of the collar.

Figure 5:
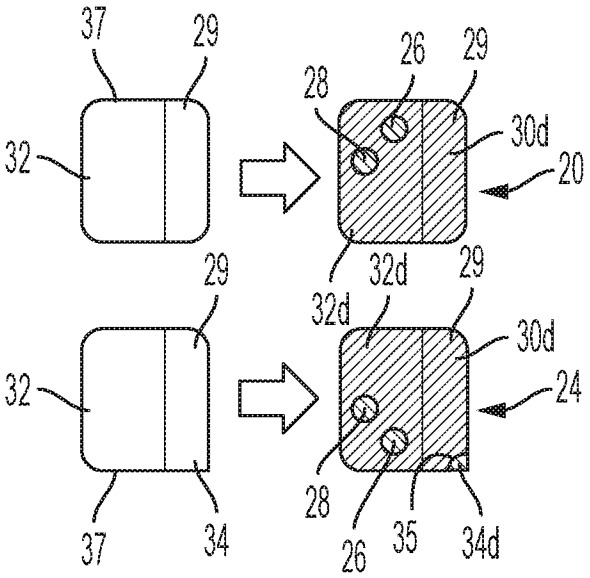
FIG. 5 is a schematic diagram of an illustrative blank and machined final component for a top section and a bottom section of a corner assembly as described herein.

FIG. 5 is a schematic diagram showing production of top section 20 and bottom section 24 of corner assembly 18. A collar corner blank 37 is molded for each section, including column mating portion 29 and standoff 32. Blank 37 differs for top section 20 and bottom section 24, as bottom section 24 includes alignment structure 34.

Datum surfaces of each blank are machined to achieve precise engagement with other components of the corner assembly, the collar, and/or the column. Datum surfaces shown in FIG. 5 include bolt holes 26, 28, planar surface 34*d* and curved surface 35 of alignment structure 34, foot surfaces 30*d*, and standoff surfaces 32*d*. In some examples, additional datum surfaces may be machined, such an inner column-facing surface each foot 30. Specific sizes and measurements according to which the machining is performed may vary according to the size of beam and/or column.

Non-datum surfaces and/or features may also be machined, to conform to a more rigorous specification than was used in the molding process, to add features that differ between the top and bottom sections, and/or as needed to produce a desired top or bottom section. For example, as shown in FIG. 3, an inner surface of t-shaped structure 33 may be machined to a desired smoothness and/or weld prep recesses may be machined into an edge adjacent middle section 22.

FIG. 6 shows a flange assembly 16, which includes upper and lower transverse elements connected by a bridging component. These may be referred to as a top flange 36 and a bottom flange 38, connected by an insert 40. The top and bottom flanges are generally matching, but mirrored. Insert 40 may be a rectangular bar or other elongate member, with a length chosen according to a desired size of flange assembly 16. The flange assembly may be sized to match a depth and weight of an I-beam or other structural member.

As shown for bottom flange 38 in FIG. 7, each of the top and bottom flanges include a main body portion 42 with first and second end portions 45 and a central span 44. End portions 45 extend generally parallel with central span 44. Angled wing portions 48 extend from the first and second end portions. Beam-facing side 54 of each end portions is a primary datum surface 45*d*. Each surface 45*d* may contact a datum surface on a corresponding corner assembly in the assembled collar. Beam facing side 54 of each wing portion 48 may also be a datum surface 48*d*.

Referring again to FIG. 6, on each flange a brace or crosspiece 46 extends generally perpendicularly from main body portion 42 and wing portions 48. Each wing portion 48 has an outside portion and an inside portion, divided by crosspiece 46. The outside portion includes an outer bolt hole 26 and the inside portion includes an inner bolt hole 28. In the present example, outer bolt hole 26 is proximal to a central axis BB of the flange assembly, while inner bolt hole 28 is distal from the central axis. Holes 26, 28 may also be described as aligned along a line oblique to a central axis BB. Central axis BB may be parallel to insert 40 and may bisect central span 44.

In the assembled collar, bolts extending through the inner and outer bolt holes transfer loads between components of the collar, in particular bending loads from attached beams. A larger proportion of loads may be applied to bolts in the outside portion of each flange. The distance of each bolt from a central axis of the beam may determine the moment arm and consequently the mechanical advantage. Decreasing the number of bolts in each wing portion can result in breaking of the collar, if the mechanical advantage is too great.

Accordingly, outer bolt hole 26 is located to minimize the moment arm. As shown in FIG. 7, the outer bolt hole is disposed immediately adjacent end portion 45 of main body portion 42. In the present example, inner bolt hole 28 is disposed proximate a distal edge 62 of wing portion 48. Such positioning of the inner bolt hole may allow access for tools used to install and tighten bolts. For some tools and/or bolts, insert 40 may interfere when inner bolt hole 28 is closer to central axis BB. In some examples, fasteners may be used which allow inner bolt hole 28 to be disposed in vertical alignment with outer bolt hole 26, immediately adjacent end portion 45.

Such locations of bolt holes 26, 28 may allow use of only two bolts at each wing portion, simplifying collar connection while maintaining connection strength. Fewer bolts may result in less machining time for bolt holes, reduced material cost for bolts, and improved installation times. In some examples, 3 bolt holes may be included (as in example C described below), the number of holes in different wing portions may vary, and/or other numbers of holes in other configurations may be used to achieve a desired load transference.

Top flange 36 and bottom flange 38 are configured to limit weight by omitting material unnecessary to structural strength. Along with the weight reducing shapes of the collar corner assemblies, this may improve a strength to weight ratio of the collar. For example, a collar may achieve a ratio of between 5,000 and 9,000 pounds of force per pound of mass (or between 2,200 and 4,000 kilograms of force per kilogram of mass). For this reason, wing portions 48 and crosspiece 46 have curved profiles, and cutouts such as recesses 43. The outside portion of each wing 48 is smaller than the inside portion, with a cut-off corner having a diagonal border distal from central span 44.

As shown for bottom flange 38 in FIG. 7, end portions 45 of main body portion 42 narrow from wing portions 48 to central span 44. Central span 44 may be described as having a height 47 that is less than a height 49 of wing portions 48. The top and bottom flanges may also be described as asymmetrical about crosspiece 46, and/or as having a butterfly shape. The rounded profiles of the flanges may also facilitate easy assembly of the collar beam mount, guiding a slightly misaligned flange assembly into correct alignment.

When assembled into full moment collar 10 as shown in FIG. 1, column facing side 54 of central span 44 is proximate face 13 of column 12 but spaced from the column. Each beam 14 is mounted to a flange assembly 16, with flanges 19 of the beam contacting beam facing side 56 of crosspiece 46 of top flange 36 and bottom flange 38, and web 17 of the beam contacting insert 40 of the flange assembly.

Figure 8:
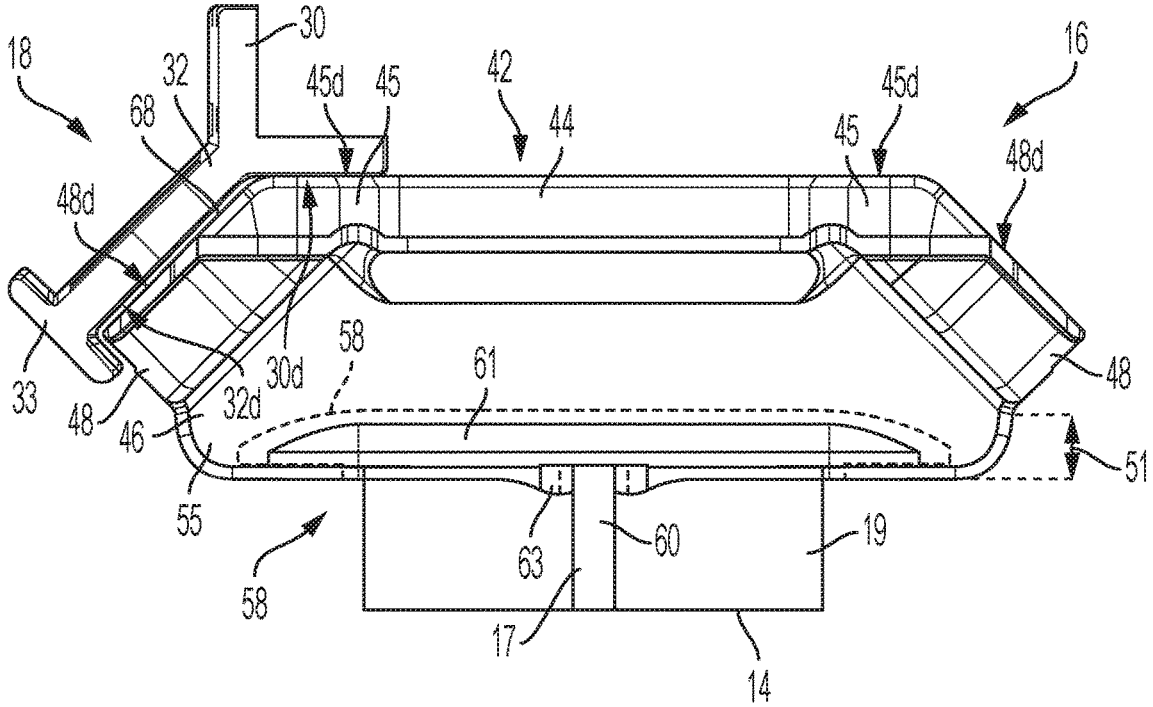
FIG. 8 is a top view of the flange assembly of FIG. 6.

Contact between an upper flange 19 of beam 14 and crosspiece 46 of top flange 36 is shown in more detail in FIG. 8, with the beam depicted as transparent. Contact between the beam and bottom flange 38 is similar but mirrored, so the following description may apply for the described features on both top and bottom flanges. Crosspiece 46 of top flange 36 includes a beam docking structure 58 on the outer face at beam facing side 56, configured to receive an end portion of beam 14.

Docking structure 58 includes a recess in an outer side of crosspiece 46, which is defined by a planar seat 59 and an inclined wall 61. Seat 59 is configured to support a portion of upper beam flange 19. A protrusion 63 extends out from beam facing side 56 of crosspiece 46, proximate a central portion of seat 59. A slot 60 in protrusion 63 is configured to receive an end portion of web 17 of beam 14.

Seat 59 and slot 60 of docking structure 58 may support and stabilize the end portion of beam 14 during welding to the flange assembly. Such stability may simplify and improve safety of welding. Docking structure 58 is also shaped to accommodate fill material used in welding beam 14 to top flange 36. Such fill material may be contained between the beam end and inclined wall 61.

Docking structure 58 is dimensioned to correspond to beam 14. FIG. 8 also depicts another possible docking structure 58*a*, indicated in dashed lines, appropriate to a heavier beam having a greater web thickness 23 and flange width 25 (See FIG. 1). When upper flange 19 is machined from a blank, a beam size may be selected and docking structure 58, 58*a*, or any appropriate docking structure may be machined into crosspiece 46 of the blank.

Crosspiece 46 extends past wings 48 on beam facing side 56. Crosspiece 46 may be described as having an extension depth 51, measured from furthest extent of wings 48 in a beam-ward direction. Depth 51 may be sufficient that beam docking structure 58 is disposed beam-ward of the wings. This extension of the crosspiece may strengthen each of the top and bottom flanges against bending loads from beam 14.

As indicated in FIG. 6, crosspiece 46 of each of the top flange 36 and bottom flange 38 has an inner face 53 proximate the inside portions of wings 48 and an outer face 55 proximate the outside portions of the wings. Outer face 55 of bottom flange 38 is shown more clearly in FIG. 10, and inner face 53 of upper flange 36 is shown more clearly in FIG. 8. On each flange, crosspiece 46 tapers toward beam-facing side 56. In other words, each Tapering of crosspiece 46 may help to ameliorate any increases in manufacturing complexity resulting from extension of the crosspiece by depth 51.

As shown in FIG. 8, flange 19 of connecting beam 14 may define a plane. Inner face 53 and outer face 55 may be described as angled relative to the beam flange plane. Outer face 55 may be disposed at a greater angle than inner face 53. For example, outer face 55 may be angled between two and ten degrees and inner face 53 may be angled between five and fifteen degrees. The angles may be large enough to simplify molding of a blank for the upper and lower flanges, particularly when the blank is forged. The angles may be small enough not to adversely affect strength of crosspiece 46 and/or interfere with correct spatial positioning of collar components.

Also shown in FIG. 8 is a collar corner assembly 18, engaging collar flange assembly 16. The corner and flange assemblies are depicted in an ideal engagement position. Datum surface 45*d* of main body portion 42 of the flange assembly is in contact with datum surface 30*d* of foot 30 of the corner assembly. Wing surface 48*d* is spaced from standoff surface 32*d* by a gap 68. When assembled into a collar 10, as shown in FIG. 1, this position may provide ideal load paths and clamping of column 12. Bending loads on each beam 14 may be transferred through the collar and around the column to the other beams.

However, maintaining gap 68 when collar 10 is fastened together with horizontal bolts 27 may require exacting manufacturing standards and robust, heavy collar components. On the other hand, closing gap 68 may increase the mechanical advantage of beams 14 on collar 10, increasing the moment arm. Such increase may be sufficient to break components of a collar.

Collar 10, as disclosed herein, is configured to allow use without gap 68 and without damage to the collar. Multiple features and properties may be combined to achieve such configuration. Position of bolt holes 26, 28 as discussed in reference to FIG. 7 above may decrease bolting loads. Extension 51 of crosspiece 46 as discussed in reference to FIG. 8 above may increase the strength of the flange assembly. Collar 10 may comprise a more flexible material, may have a reduced weight as discussed in reference to FIGS. 3 and 7 above, and may be configured for use with lighter beams for a given desired span. Allowing gap 68 to be closed in installation due to manufacturing or construction imprecision may allow less rigorous manufacturing and installation standards. Such standards may in turn reduce costs, speed up production, and open up additional options for manufacturing methods.

Figure 9:
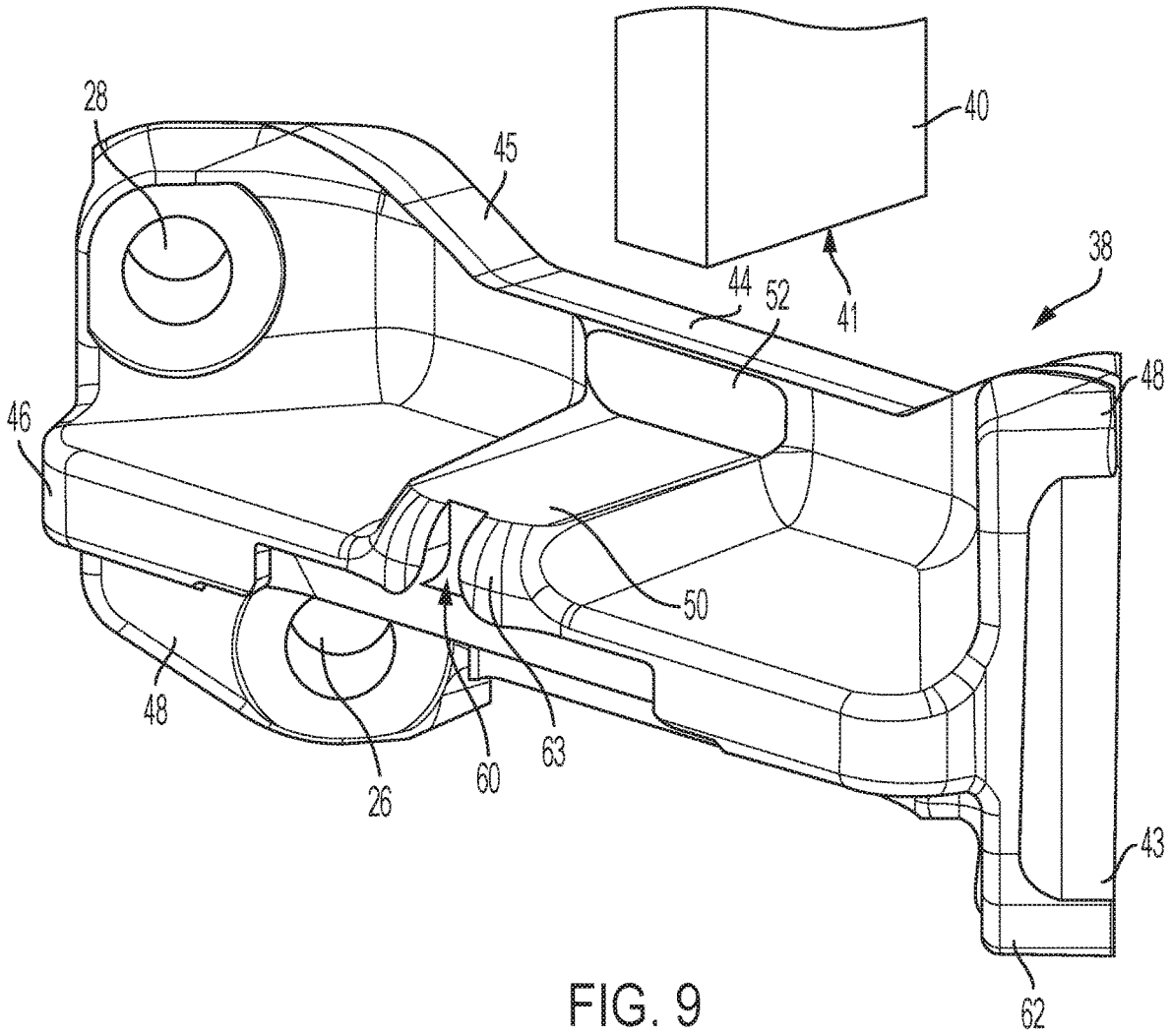
FIG. 9 is an isometric rear view of the bottom transverse element of the flange assembly of FIG. 6, including a partial view of the bridging component.

As shown in FIG. 9, each of bottom flange 38 and top flange 36 includes an interface structure which is configured for connection of insert 40. The interface structure includes a raised plateau 50 on inner face 53 of crosspiece 46 and an adjacent raised surface 52 of central span 44. The raised plateau is disposed centrally on the inside face of crosspiece 46, and protrusion 63 extends from a beam facing end of the plateau.

Raised plateau 50 contacts an end surface 41 of insert 40 and raised surface 52 contacts a column facing surface of the insert. Insert 40 may be described as a rectangular prism and/or a rectangular bar having first and second planar ends. Accordingly, raised plateau and raised surface are each planar. Such a planar interface may allow insert 40 to be cut from rectangular bar stock to a desired length, without additional shaping.

Raised plateau 50 and raised surface 52 may be machined into a molded flange blank, and precisely located relative to bolt holes 26, 28. Insert 40 may be thereby precisely located relative to the bolt holes of top flange 36 and bottom flange 38, ensuring a precise spacing between bolt holes of the top and bottom flanges.

Bottom flange 38 is also configured to engage the alignment structures of corresponding corner assemblies. As shown in FIG. 7, bottom flange 38 includes a curved bottom surface 64 recessed into end portions 45 of main body portion 42. Bottom surface 64 has a horizontal planar section 64*d*, at a top of the curve. Bottom surface 64 may be machined into a molded flange blank.

Figure 10:
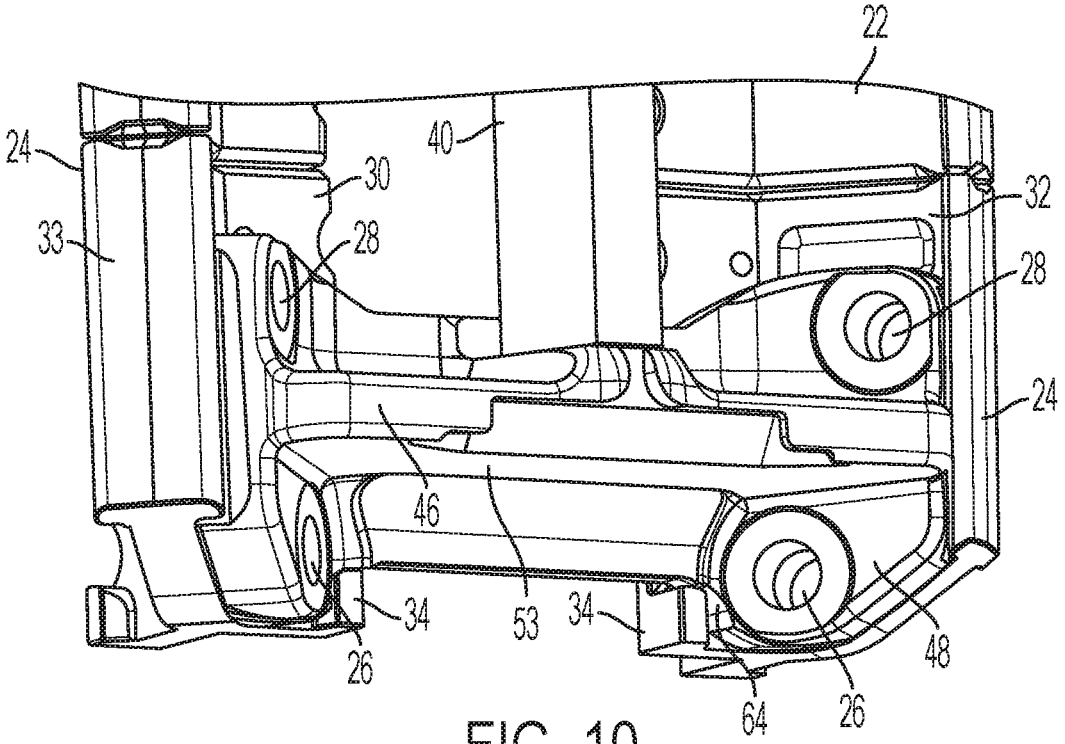
FIG. 10 is a partial isometric view of a flange assembly and two corner assemblies of the collar of FIG. 2, engaged.

FIG. 10 shows a flange assembly 16 received between two corner assemblies 18, with bottom flange 38 engaging bottom sections 24. Column facing side 54 of central span 44 contacts an adjacent foot of each bottom section. Column facing side 54 of each wing portion 48 may contact standoff 32 of the corresponding corner assembly, or may be spaced from the standoff by a gap, as discussed above. Inner bolt holes 26 and outer bolt holes 28 of bottom flange 38 and of bottom section 24 are aligned.

Alignment structures 34 of corner assemblies 18 extend under end portions 45 of main body portion 42 of bottom flange 38. Planar section 64*d* of bottom surface 64 of the central span rests on planar surface 34*d* of each alignment structure. Bottom flange 38, and therefore the flange assembly, are thereby precisely vertically located relative to the corner assemblies.

Bottom surface 64 may be described as shaped inversely to alignment structure 34. Specifically, the bottom surface may include a curved, sloped, or graduated surface complementary to upper surface 35 of the alignment structure. Once flange assembly 16 is received in the correct position, the curved portion of bottom surface 64 is spaced from curved surface 35 of alignment structure 34. The two curved surfaces may engage as the flange assembly is lowered between the corner assemblies, to guide the flange assembly to a precise horizontal position. That is, when a corner of bottom surface 64 contacts curved surface 35, the bottom flange 38 may be horizontally adjusted as the corner slides along and down the curved surface to the correct position.

Figure 11:
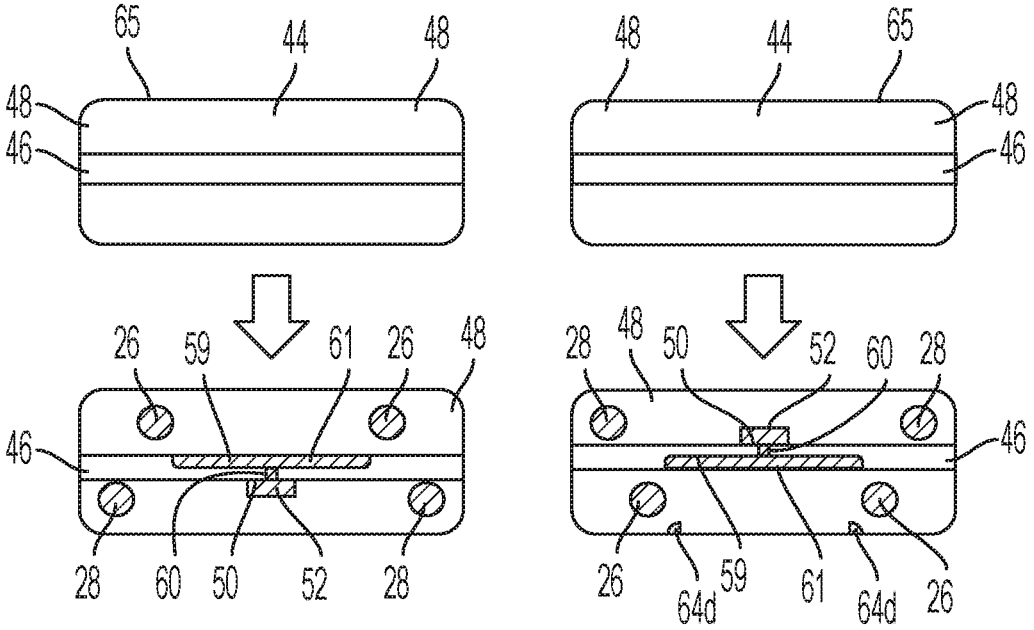
FIG. 11 is a schematic diagram of an illustrative blank and machined final component for a top transverse element and a bottom transverse element of a flange assembly as described herein.

FIG. 11 is a schematic diagram showing production of a top flange 36 and a bottom flange 38 of flange assembly 16. A collar flange blank 65 is molded, including central span 44, crosspiece, and wing portions 48. Top flange 36 and bottom flange 38 may be produced from identical blanks, but machining differs between the flanges.

Datum surfaces of the blank are machined to achieve precise engagement with other components of the flange assembly, collar, and/or the beam. For example, datum surfaces shown in FIG. 11 include bolt holes 26, 28; raised plateau 50 and raised surface 52 of the insert interface; and seat 59 and slot 60 of docking structure 58. Other datum surfaces, on the column-facing side of a flange and indicated in FIG. 7, include main body end portion surfaces 45*d* and wing surfaces 48*d*. On bottom flange 38, bottom surface 64*d* is also machined.

Referring again to FIG. 11, bolt holes 26, 28 may be machined to line up with the corresponding holes of a connected corner assembly. The insert interface surfaces 50 and 52 may locate the top and bottom flange relative to one another along a vertical axis, by correctly locating the insert. The surfaces of docking structure 58 may contact the corresponding beam to precisely locate the beam relative to the flange assembly. Column-facing surfaces 45*d*, 48*d* may contact datum surfaces of the corner assemblies to locate the flange in the horizontal or column-orthogonal plane. Bottom surface 64*d* may correctly locate the flange assembly relative to alignment structure 34 of the corner assemblies, along both vertical and horizontal axes. The relative positions of each of these surfaces may also be important to correct overall spatial configuration of the flange assembly, and the collar.

In some examples, additional datum surfaces may be machined on one or both of the flange blanks, such as the column facing side of each wing portion 48, and surfaces proximate wing portions 48 on the column facing side of central span 44. These surfaces may contact datum surfaces of the corner assembly to locate the flange in the horizontal or column-orthogonal plane. Specific sizes and measurements according to which the machining is performed may vary according to the size of beam and/or column.

Non-datum surfaces and/or features may also be machined, to conform to a more rigorous specification than was used in the molding process, to add features that differ between the top and bottom flanges, and/or as needed to produce a desired top or bottom flange. For example, as shown in FIG. 7, each wing portion 48 has a side edge 62. The side edge may be machined to an angle relative to insert 40 or a vertical axis of the flange assembly. This angle is not mirrored between top and bottom flanges, resulting in an overall tapering of the flange assembly. The taper may correspond to the tapered channels of the corner assemblies. For another example, as shown in FIG. 6, each bolt hole 26, 28 includes a counterbore 70 on beam facing side 54 of the flange assembly. The flange blank may include an appropriately located molded recess, which may be finished into counterbore 70 by machining.

Figure 12:
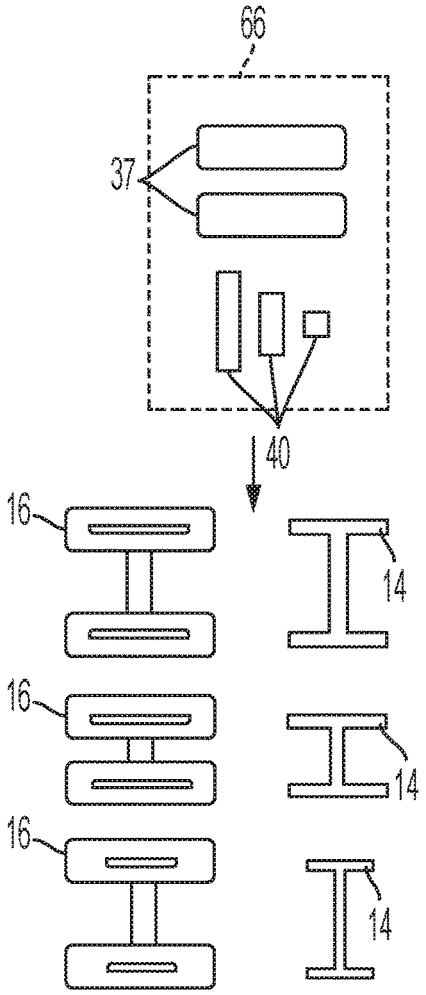
FIG. 12 is a schematic diagram of flange assembly configuration according to beam size, from a set of standard blanks.

FIG. 12 is another schematic diagram, depicting manufacture of a flange assembly 16. An inventory 66 of components includes collar flange blanks 37 and a range of sizes of inserts 40. In some examples, the inventory may include bar stock of standard length which may be cut to a selected length for an insert 40. In some examples, the inventory may include a single type of collar flange blank, may include blanks specific to top and/or bottom flanges, and/or may include a range of sizes of blanks.

A flange assembly 16 may be manufactured from the components of inventory 66 according to a selected size of beam 14. As shown in FIG. 1, each beam has a beam depth 21, a web thickness 23, and a flange width 25. These dimensions may vary independently or dependently. Flange assembly 16 may be independently configured for each of the three dimensions. In FIG. 12, three flange assemblies 16 are depicted, manufactured according to three different sizes of beam 14.

To match beam depth 21 of beam 14, a corresponding size of insert 40 may be selected or cut. For another example, insert 40 may be cut to an appropriate length for a W12-22, 12 inch depth beam, but may also be cut for a W21-65, W12-65, or W18-40 beam. To match web thickness 23 and flange width 25, an appropriately sized beam docking structure may be machined into collar flange blanks 37. For example, collar flange blank 37 may be wide enough to be machined to accommodate a W12-22, 22 pound per linear foot wide flange I-beam, but may also be machined to receive a W21-65, W12-65, or W18-40 beam.

Such versatile configurations may simplify manufacturing by allowing an inventory of molded flanges and bar stock to be kept on hand, and machined and/or cut on demand to create flange assemblies for each specific building project.

B. Illustrative Method of Manufacturing a Full-Moment Collar

Figure 13:
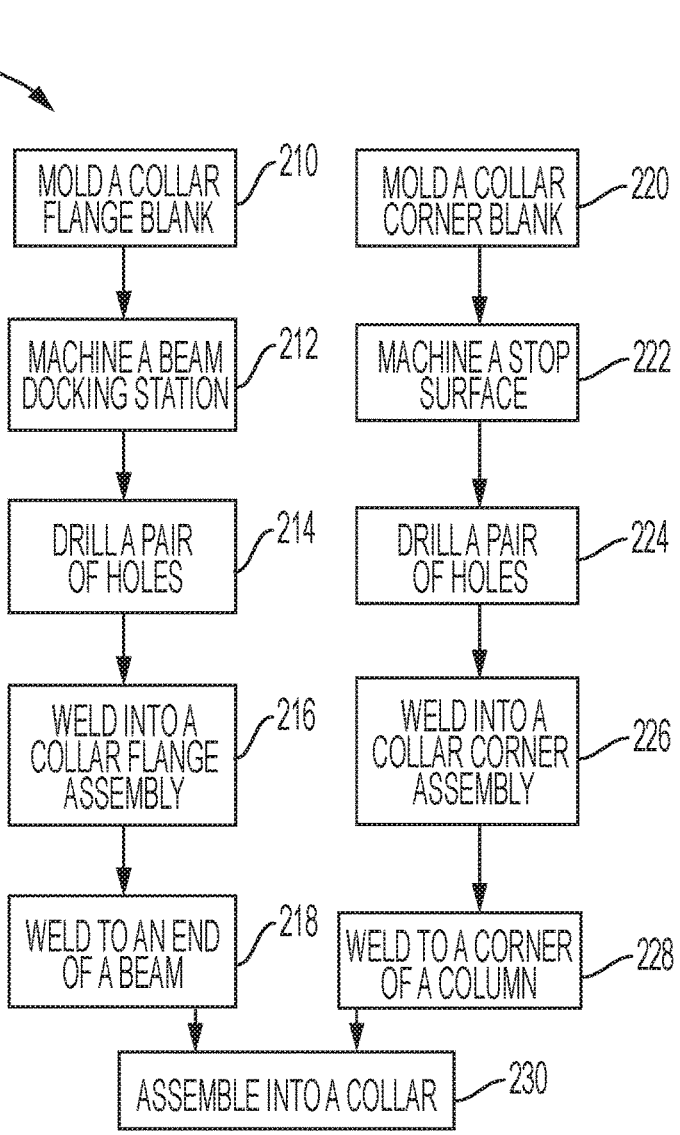
FIG. 13 is a flow chart depicting steps of an illustrative method for manufacturing a full moment collar according to the present teachings.

This section describes steps of an illustrative method 200 for manufacturing a full moment collar; see FIG. 13. Aspects of collars, components, and/or blanks described above may be utilized in the method steps described below. Where appropriate, reference may be made to components and systems that may be used in carrying out each step. These references are for illustration, and are not intended to limit the possible ways of carrying out any particular step of the method.

FIG. 13 is a flowchart illustrating steps performed in an illustrative method, and may not recite the complete process or all steps of the method. Although various steps of method 200 are described below and depicted in FIG. 13, the steps need not necessarily all be performed, and in some cases may be performed simultaneously or in a different order than the order shown.

At step 210, the method includes molding a collar flange blank. The blank may be cast, forged, extruded, additively manufactured, and/or molded by any effective method. The blank may also be referred to as a transverse element, and may include a central span with a wing portion at each end. A crosspiece may bisect the blank into outer and inner portions.

Step 212 of the method includes machining a beam docking structure. The beam docking structure may be machined into the crosspiece of the collar flange blank and may correspond to dimensions of a selected I-beam. The docking structure may include a seat and an inclined wall, with the inclined wall forming an angle of more than ninety degrees with the seat.

The docking structure may be configured to receive an end portion of a flange of the selected I-beam. When received, an inner side or web-adjacent side of the flange of the I-beam may contact the seat of the beam docking structure. The beam docking structure may further include a protrusion extending outward from a central portion of the seat. A slot in the protrusion may be configured to receive a web of the I-beam.

Step 214 of the method includes drilling a pair of holes. The pair holes may be drilled through one of the wing portions of the collar flange blank. Each hole may be sized to receive a fastener such as a bolt. Step 214 may be repeated for the other wing portion of the blank, such that the holes are symmetrical and a total of four holes are drilled. In some examples, no more than two holes may be drilled in each wing portion.

The holes may be drilled in locations precisely related to the docking structure machined in step 212. In examples where step 214 is performed prior to step 212, the docking structure may be machined in a location precisely related to the drilled holes. Each pair of holes may be located along an axis that is oblique relative to the crosspiece and/or a lateral extent of the blank. In other words, a line extending between the two holes may be angled relative to the blank.

In some examples, method 200 may further include additional machining steps. Other surfaces and/or features may be machined into the collar flange blank. Examples of such features include a web insert interface and an alignment structure engaging surface. Additional processing of the blank may also be performed, such as cleaning. Once processing is completed, the collar flange blank may be referred to as a collar flange.

Step 216 of the method includes welding the collar flange into a collar flange assembly. Steps 210-214 may be repeated to produce a second collar flange. One of the collar flanges may be configured as a top flange, and one as a bottom flange. The top flange may be welded to a first end of a web insert and the bottom flange may be welded to the second end of the web insert. In some examples, additional processing of the collar flange assembly may be performed subsequent to welding. For example, the collar flange assembly may be galvanized.

Step 218 of the method includes welding the collar flange assembly to the end of a beam. In some examples, step 218 may be omitted. Each flange of the beam may be received by the beam docking structure of one of the collar flanges of the collar flange assembly. The web of the beam may be received in both docking structures. With the beam supported and stabilized by the docking structures, the collar flange assembly may be welded to the beam.

Step 220 of the method includes molding a collar corner blank. The blank may be cast, forged, extruded, additively manufactured, and/or molded by any effective method. The blank may also be referred to as a bottom section and may include a column mating portion and a standoff portion. The column mating portion may include first and second expanses defining a corner and the standoff portion may include a distal T-shaped structure.

Step 222 of the method includes machining a stop surface on the blank. The stop surface may be a planar and/or curved surface on an upper side of an alignment structure. The alignment structure may extend from a bottom portion of the first or second expanse and may be distal from the standoff. The stop surface may be perpendicular to an adjacent surface of the respective expanse.

Step 224 of the method includes drilling a pair of holes in the blank. The pair holes may be drilled through one of the wing portions of the collar flange blank. Each hole may be sized to receive a fastener such as a bolt. The holes may be drilled in locations precisely related to the stop surface machined in step 222. In examples where step 224 is performed prior to step 222, the stop surface may be machined in a location precisely related to the drilled holes. The pair of holes may be located along an axis that is oblique relative to the corner defined by the first and second expanses, and/or a longitudinal extent of the blank. In other words, a line extending between the two holes may be angled relative to the blank. In some examples, the pair of holes may be the only holes drilled in the standoff of the blank.

In some examples, method 200 may further include additional machining steps. Other surfaces and/or features may be machined into the collar corner blank. Examples of such features include a column mating face of each of the first and second expanses and a column engaging face of the standoff. Additional processing of the blank may also be performed, such as galvanizing. Once processing is completed, the collar flange blank may be referred to as a bottom section.

Step 226 of the method includes welding the bottom section into a collar corner assembly. Steps 220 and 224 may be repeated to produce a top section, and a middle section of appropriate size may be selected. The top, middle, and bottom sections may be welded together to form a collar corner assembly having a column mating portion with first and second expanses and a standoff portion with a distal T-shaped structure. The collar corner assembly may include two pairs of, or a total of four, drilled holes in the standoff portion.

Step 228 includes welding the collar corner assembly to the corner of a column. The first and second expanses of the collar corner assembly may be welded to first and second faces of the column, adjacent a corner of the column and at a selected longitudinal position on the column. Steps 220-226 may be repeated to produce three additional collar corner assemblies, and step 228 may include welding all four collar corner assemblies to the column. The collar corner assemblies may be precisely positioned relative to one another prior to welding to the column.

Steps 210-218 may be performed in a factory or other staging area, prior to transportation to a work site. Steps 210-218 may be performed multiple times to produce a desired number of collar flange assemblies, which may or may not be welded to a beam. Steps 220-228 may also be performed in a factory or staging area. Steps 220-228 may be performed alongside steps 210-218, prior to steps 210-218, or after steps 210-218. All of steps 210-228 may be completed before materials are transported to a work site and step 230 is performed.

At step 230, method 200 includes assembling the produced collar flange assemblies and collar corner assemblies into a collar. The column may be positioned as desired at the work site, for instance may be secured to a foundation. A first beam may be positioned proximate the column, with a column facing side of the central span of the mounted flange assembly generally parallel to a face of the column, and above two corner assemblies mounted on adjacent corners of the column.

The beam may be lowered along the column, such that the wing portions of the bottom flange the flange assembly are received by the adjacent corner assemblies. The beam may be lowered until an underside of the bottom flange contacts the alignment structures of the corner assemblies. Bolt holes of each wing portion of top and bottom flanges may then be aligned with the corresponding bolt holes in the corner assemblies.

A second beam may then be lowered in the same manner at a second face of the column, and similarly for third and fourth beams until a complete collar is formed by the flange assemblies and the corner assemblies. For connection of fewer than four beams to the column, a flange assembly without a mounted beam may be lowered at one or more faces of the column.

At a top section of each corner assembly, three pairs or sets of bolt holes may be aligned. Similarly, at a bottom section, three pairs or sets of bolt holes may be aligned. A bolt may be fastened through each set of three aligned holes, for a total of 16 bolts to fasten the collar. Each wing portion may be thereby attached to a wing portion of an adjacent flange assembly, through a corner assembly. The collar may be correctly located prior to bolting and may be bolted to retain the correct alignment and support additional load transfer.

In some examples, bolting may leave a gap between each wing portion and adjacent standoff. In such examples, the collar may provide ideal load transfer by complete clamping of the collar. In some examples, the bolts may be tightened sufficiently to bring some or all of the wing portions into contact with the adjacent standoffs. The collar may be configured to tolerate anticipated loads without damage, despite partial clamping of the column resulting from such contact. Performing this bolting step without requiring a gap to be left may reduce time and cost required for manufacture and assembly of the collar.

C. Illustrative Reinforced Full-Moment Column Collar

Figure 15:
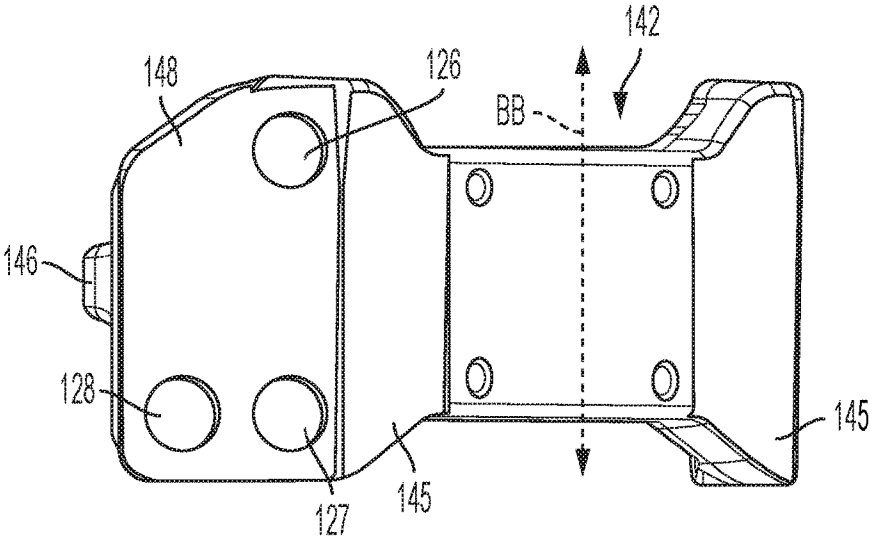
FIG. 15 is a side view of a top flange of the flange assembly of FIG. 13.
Figure 14:
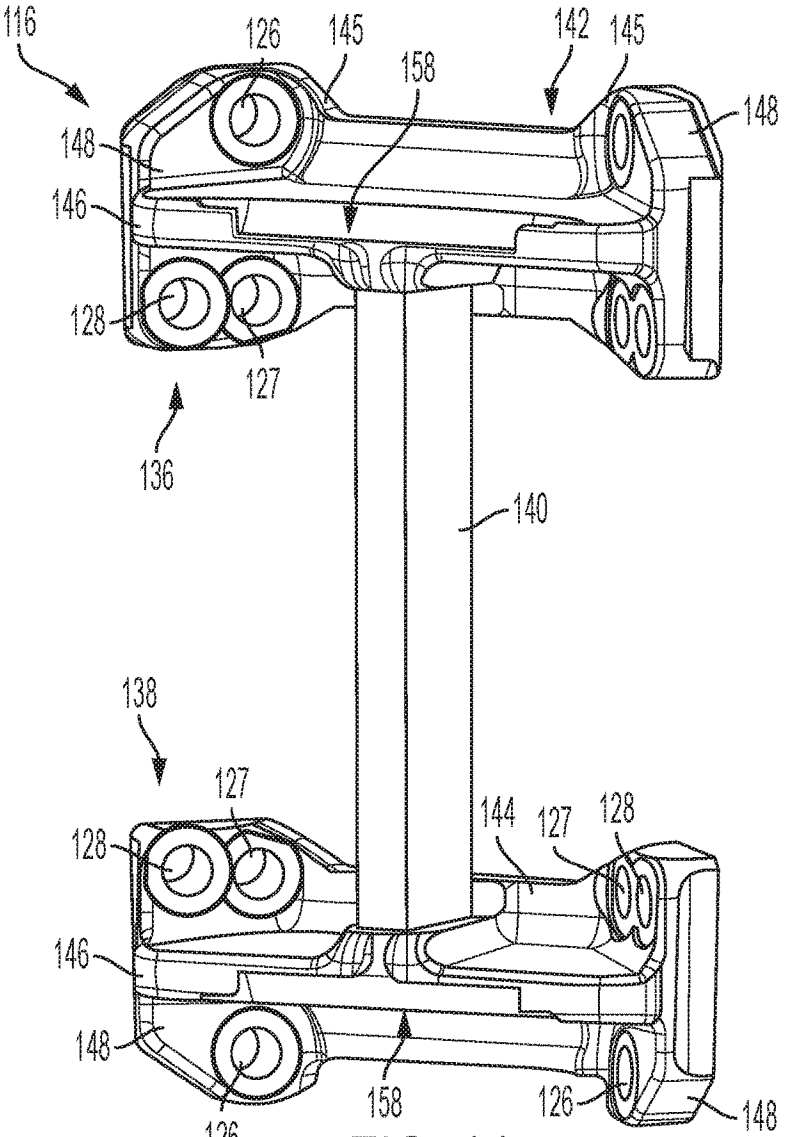
FIG. 14 is an isometric view of a flange assembly of another illustrative full-moment column collar in accordance with aspects of the present disclosure.

As shown in FIGS. 14 and 15, this section describes another example of a full-moment collar connection system, as described above. The present example may be appropriate to structures or other applications including larger beams or requiring greater load capacity.

FIG. 14 shows a flange assembly 116, which is configured to connect with another three flange assemblies and four corner assemblies to form a collar. Flange assembly 116 is largely similar to flange assembly 16 of collar 10, as described above, but includes additional holes to allow use of a greater number of horizontal bolts. The additional bolts, when located as described in greater detail below, may provide additional load transfer between a beam and column connected by the collar. The total number of bolts required for the collar of the present example may still be a reduction from the number of fasteners required for known full-moment connections. Use of the fewest possible bolts may be preferred for speed and ease of construction, and the collar of the present example may be selected only for connections requiring reinforcement.

Flange assembly 116 includes a top flange 136 and a bottom flange 138 connected by an insert 140. The flange assembly may be sized to match a depth and weight of an !-beam or other structural member, both by selection of an insert of appropriate length and by forming a beam docking structure 158 of appropriate dimensions. Top flange 136 and bottom flange 138 may be produced from molded blanks, with key surfaces such as the beam docking structure 158 precisely machined into the blank.

Top flange 136 and bottom flange 138 are generally matching, but with many features mirrored and some differing features. Each flange includes a main body with angled wing portions 148 extending from first and second end portions 145, and a crosspiece 146. Each wing portion includes an outside portion and an inside portion, divided by crosspiece 46. On top flange 136, the outside portion may be described as an upper portion, and the inner portion may be described as a lower portion. By contrast, on bottom flange 138, the outside portion may be described as a lower portion and the inner portion may be described as an upper portion. The outside portion of each flange includes an outer bolt hole 126. The inside portion of each flange includes two inner bolt holes, a proximal inner bolt hole 127 and a distal inner bolt hole 128.

Bolt holes 126, 127, and 128 may be described as arranged at the corners of a right triangle. The two proximal bolt holes, outer bolt hole 126 and proximal inner bolt hole 127 are vertically stacked. Bolt holes 126 and 127 may be described as aligned on a vertical axis BB, where axis BB is parallel to a longitudinal axis of flange assembly 116. The two inner bolt holes, 127 and 128 are horizontally adjacent. Distal inner bolt hole 128 and outer bolt hole 126 may be described as aligned along a line oblique to axis BB.

As described above regarding example A, bolts extending through the inner and outer bolt holes transfer loads between components of the assembled collar, in particular bending loads from attached beams. The distance of each bolt from a central axis of the beam may determine the moment arm and consequently the mechanical advantage. Accordingly, outer bolt hole 126 and proximal inner bolt hole 127 are located to minimize the moment arm. The outer bolt hole and proximal inner bolt hole are each disposed immediately adjacent end portion 145 of main body 142.

Flange assembly 116 may be fastened through two adjacent corner assemblies of the collar, to a further two flange assemblies. Each corner assembly may include three bolt holes in a top section and three bolt holes in a bottom section, corresponding to bolt holes 126, 127, 128 of flange assembly 116. The flange assemblies and corner assemblies may be fastened by a plurality of horizontal bolts. In the present example, each corner assembly may be fastened by six bolts, and the collar may be fastened by a total of twenty four bolts.

Illustrative Combinations and Additional Examples

This section describes additional aspects and features of full moment connection collar systems, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. A method of manufacturing a full moment column collar, comprising:

molding a collar flange blank, and machining a beam docking structure in the collar flange blank corresponding to a selected I-beam flange dimension, wherein the beam docking structure includes a seat configured to contact an I-beam flange.

A1. The method of A, wherein the seat is configured to contact a top side of an I-beam flange.

A2. The method of A or A1, wherein the seat is configured to contact a bottom side of an I-beam flange.

A3. The method of any of A-A2, wherein the beam docking structure includes a protrusion extending outward from a central portion of the seat, the protrusion having a slot configured to receive a web portion of an I-beam.

A4. The method of any of A-A3, wherein the collar flange blank has a pair of wing portions, further comprising:

drilling a pair of holes in each wing portion in locations precisely related to the beam docking structure.

A5. The method of A4, wherein the pair of holes in each wing portion are located along an oblique axis.

A6. The method of A4 or A5, wherein the pair of holes in each wing portion are the only holes in the respective wing portion.

A7. The method of A4 or A5, further including drilling a third hole in each wing portion.

A8. The method of any of A-A7, wherein the beam docking structure has an inclined wall extending from the seat.

A9. The method of A8, wherein the inclined wall forms an angle with the seat of more than ninety degrees.

A10. The method of any of A-A9, further including machining a bridging component interface structure in the collar flange blank, wherein the interface structure includes first and second planar surfaces.

A11. The method of any of A-A10, further including cutting a bridging component of a selected length from an elongate member of a standard length.

B. A method of manufacturing a full moment column collar, comprising:

molding a collar corner blank having first and second expanses defining a corner, and a standoff portion extending from the corner, the standoff portion having a distal T-shaped structure, and machining a stop surface on the collar corner blank configured to contact a surface on a flange assembly.

B1. The method of B, further comprising:

drilling a pair of holes in the standoff portion in locations precisely related to the stop surface.

B2. The method of B1, wherein the pair of holes are located along an oblique axis.

B3. The method of B1 or B2, wherein the pair of holes in the standoff portion are the only holes in the standoff portion.

B4. The method of B1 or B2, further including drilling a third hole in the standoff portion.

B5. The method of any of B-B4, further comprising machining a curved or sloped guide surface proximate the stop surface.

B6. The method of B5, wherein the guide surface and the stop surface are machined on am alignment structure of the collar corner blank.

C. A flange assembly, comprising:

an upper transverse element, a lower transverse element, and a bridging component connecting the upper and lower transverse elements, wherein each transverse element has a middle portion connecting first and second wing portions, the middle portion being connected to the bridging component, wherein each wing portion has less than four bolt holes configured for attachment to wing portions on adjacent flange assemblies.

C1. The flange assembly of C, wherein each wing portion has no more than three bolt holes.

C2. The flange assembly of C or C1, wherein each wing portion has no more than two bolt holes.

C3. The flange assembly of C2, wherein the bolt holes on each wing portion are aligned along a first axis oblique to an elongate axis of the bridging component.

C4. The flange assembly of an of C-C3, wherein one of the bolt holes is immediately adjacent the middle portion.

C5. The flange assembly of any of C1-C4, wherein each wing portion has an inside portion and an outside portion, the inside portion having a bolt hole distal from the middle portion, the outside portion having a bolt hole proximal from the middle portion.

C6. The flange assembly of any of C1-C5, wherein each wing portion has an inside portion and an outside portion, the outside portion having a bolt hole immediately adjacent the middle portion.

C7. The flange assembly of any of C-C5, wherein the upper and lower transverse elements are comprised of forged metal, and the bolt holes are machined into the forged metal.

C8. The flange assembly of any of C-C7, wherein the upper and lower transverse elements each include a brace portion extending perpendicularly from the wing portions and the central portion, and first and second bolt holes are disposed on either side of the brace portion in each wing portion.

C9. The flange assembly of C8, wherein the brace portion is tapered in a beam-ward direction.

C10. The flange assembly of C8 or C9, wherein the brace portion includes an outer surface and an inner surface, each surface being disposed at an angle relative to the flange of a beam connected to the flange assembly.

C11. The flange assembly of C10, wherein the outer surface is disposed at an angle in a range of approximately 2 degrees to 10 degrees and the inner surface is disposed at an angle in a range of approximately 5 degrees to 15 degrees.

C12. The flange assembly of any of C-C11, wherein the bridging component is a rectangular prism.

C13. The flange assembly of any of C-C12, wherein each transverse element includes an interface structure configured for connection with the bridging component, the interface structure including two orthogonal planar surfaces.

C14. The flange assembly of any of C-C13, wherein the middle portion includes a central span and first and second end portions, the first and second end portions each narrowing from the wing portions to the central span.

C15. The flange assembly of C14, wherein the central span has a smaller vertical height than a vertical height of the wing portions.

C16. The flange assembly of any of C-C15, wherein the transverse elements have curved profiles configured to reduce material weight.

C17. The flange assembly of any of C-C16, wherein the flange assembly has a bending load to weight ratio of between approximately 5000 and 9000 pounds of force per pound of weight.

D. A collar corner assembly, comprising:

a column mating portion having first and second expanses defining a corner, and a standoff portion extending from the corner, the standoff portion having less than eight bolt holes.

D1. The collar corner assembly of D, wherein a first axis is parallel to the corner, the standoff portion having two sets of holes, each set of holes being aligned along a second axis oblique to the first axis.

D2. The collar corner assembly of D or D1, wherein at least two bolt holes are immediately adjacent the standoff portion.

D3. The collar corner assembly of any of D-D2, wherein the column mating portion and the standoff portion each have a standard upper section and a standard lower section connected by a selectable middle section corresponding to a beam depth, and each of the upper section and the lower section includes a set of holes.

D4. The collar corner assembly of D3, wherein each set of holes includes no more than three holes.

D5. The collar corner assembly of D3 or D4, wherein each set of holes includes no more than two holes.

D6. The collar corner assembly of any of D3-D5, wherein the upper and lower sections each have an inside portion and an outside portion, the inside portion having a bolt hole distal from the corner, the outside portion having a bolt hole proximal from the corner.

D7. The collar corner assembly of any of D3-D5, wherein the upper and lower sections each have an inside portion and an outside portion, the outside portion having a bolt hole immediately adjacent the standoff portion.

D8. The collar corner assembly of D6 or D7, wherein the upper and lower sections are comprised of forged metal, and the bolt holes are machined into the forged metal.

E. A full-moment beam connection system, comprising:

four flange assemblies, each flange assembly including an upper transverse element, a lower transverse element, and a bridging component connecting the upper and lower transverse elements, and four collar corner assemblies, each collar corner assembly including a column mating portion having first and second expanses defining a corner, and a standoff portion extending from the corner, the standoff portion having a distal T-shaped structure, wherein each collar corner assembly is configured to extend from a corner of a column and connect two adjacent flange assemblies via less than eight bolts, collectively forming a full-moment connection mechanism encompassing a column.

E1. The connection system of E, wherein each collar corner assembly is configured to connect two adjacent flange assemblies via two pairs of bolts, each pair of bolts being aligned along a non-vertical axis.

E2. The connection system of E, wherein each collar corner assembly is configured to connect two adjacent flange assemblies via two pairs of bolts, one of each pair of bolts being configured to minimize mechanical advantage of bending loads applied to the system.

E3. The connection system of E1 or E2, wherein each pair of bolts includes an inner bolt and outer bolt, the inner bolt being distal from the column and the outer bolt being proximal from the column.

E4. The connection system of any of E-E3, wherein the system includes no more than twenty four bolts.

E5. The connection system of any of E-E4, wherein the system includes no more than sixteen bolts.

E6. The connection system of any of E-E5, further including a beam fixed to one of the four flange assemblies.

F. A collar corner assembly, comprising:

a column mating portion having first and second expanses defining a corner, and a standoff portion extending from the corner, the standoff portion having a distal T-shaped structure, wherein the first expanse has an alignment structure adjacent a bottom end portion.

F1. The collar corner assembly of F, wherein the alignment structure is positioned distally from the corner.

F2. The collar corner assembly of F or F1, wherein the alignment structure has a planar top face configured to contact a bottom surface of a lower transverse element of a flange assembly.

F3. The collar corner assembly of F2, wherein the collar corner assembly is comprised of forged metal, and the planar top face of the alignment structure is formed by machining of the forged metal.

F4. The collar corner assembly of F2 or F3, wherein the alignment structure has a curved surface configured to mate with a complementary portion of the bottom surface of the lower transverse element of the flange assembly.

F5. The collar corner assembly of any of F-F4, wherein the column mating portion and the standoff portion each have a standard upper section, and standard lower section connected by a selectable middle section corresponding to a beam depth.

F6. The collar corner assembly of any of F-F5, wherein the first expanse has a planar surface and the alignment structure extends perpendicular to the planar surface.

F7. The collar corner assembly of any of F-F6, wherein the first expanse has a first surface configured to contact a face of a column and a second surface opposite and parallel the first surface, the alignment structure protruding from the second surface.

F8. The collar corner assembly of any of F-F7, wherein the first expanse and the second expanse are perpendicular, each expanse forming an angle of approximately 45 degrees with the standoff portion.

F9. The collar corner assembly of any of F-F8, wherein the second expanse has an alignment structure adjacent a bottom end portion.

F10. The collar corner assembly of any of F-F9, wherein the standoff portion is transected by a plurality of holes.

G. A full-moment beam connection system, comprising:

four flange assemblies, each flange assembly including an upper transverse element, a lower transverse element, and a bridging component connecting the upper and lower transverse elements, and four collar corner assemblies, each collar corner assembly including a column mating portion having first and second expanses defining a corner, and a standoff portion extending from the corner, the standoff portion having a distal T-shaped structure, wherein each collar corner assembly is configured to connect two adjacent flange assemblies, wherein each collar corner assembly has alignment structures extending from a bottom end portion for positioning a lower transverse element of a respective flange assembly.

G1. The full-moment beam connection system of G, wherein each two adjacent flange assemblies connected by a collar corner assembly are secured by a horizontal bolt extending through corresponding holes in the collar corner assembly and each of the flange assemblies.

G2. The full-moment beam connection system of G or G1, wherein each alignment structure has a planar top face configured to contact a bottom surface of a lower transverse element of an adjacent one of the four flange assemblies, and vertically position the contacted flange assembly.

G3. The full-moment beam connection system of G2, wherein each alignment structure includes a shoulder surface configured to contact a complementary surface of a lower transverse element of an adjacent one of the four flange assemblies, and urge the contacted flange assembly to a correct horizontal position.

G4. The full moment beam connection system of any of G-G3, further including:

a column having four corners, one of the four collar corner assemblies being fixed to each of the corners of the column, and a beam having an end fixed to one of the four flange assemblies.

G5. The full moment beam connection system of G4, wherein each alignment structure extends perpendicular to an adjacent face of the column.

H. A method of connecting a beam to a column, comprising:

positioning a first flange assembly adjacent a first face of a column, the first face extending between a first corner and a second corner of the column, a first collar corner assembly being fixed to the first corner, a second collar corner assembly being fixed to the second corner, and the first flange assembly being fixed to an end of a beam, aligning the first flange assembly above a first channel defined between the first and second column corner assemblies and the first face of the column, lowering the first flange assembly down the first channel, contacting a bottom surface of a lower transverse element of the first flange assembly with a top surface of a first alignment structure protruding from the first collar corner assembly, and fastening the first flange assembly to the first collar corner assembly.

H1. The method of H, wherein the top surface of the alignment structure is planar.

H2. The method of H or H1, wherein each collar corner assembly includes a column mating portion having first and second expanses defining a corner, and a standoff portion extending from the corner, the standoff portion having a distal T-shaped structure.

H3. The method of any of H-H2, further including the steps of:

positioning a second flange assembly adjacent a second face of the column, the second face extending between the first corner and a third corner, and a third collar corner assembly being fixed to the third corner, aligning the second flange assembly above a second channel defined between the first and third column corner assemblies and the second face of the column, lowering the second flange assembly down the second channel, contacting a bottom surface of a lower transverse element of the second flange assembly with a top surface of a second alignment structure protruding from the first collar corner assembly, and fastening together the first flange assembly, the second flange assembly, and the first collar corner assembly.

H4. The method of H3, wherein the fastening step includes tightening a nut on a bolt such that a wing portion of a transverse element of a flange assembly is brought into contact with a standoff portion of an adjacent collar corner assembly.

J. A full-moment column collar, comprising:

four collar flange assemblies, each collar flange assembly including an upper transverse element, a lower transverse element, and a bridging component connecting the upper and lower transverse elements, and four collar corner assemblies, each collar corner assembly including first and second expanses defining a corner and a standoff portion extending from the corner, the standoff portion having a distal T-shaped structure, wherein each collar corner assembly is configured to connect two adjacent collar flange assemblies, and each collar corner assembly has a multi-axis alignment structure extending from a bottom end portion for vertically positioning a lower transverse element of a respective collar flange assembly.

J1. The full-moment column collar of J, wherein the alignment structure has a planar top face configured to contact a bottom surface of a lower transverse element of an adjacent one of the four collar flange assemblies.

J2. The full-moment column collar of J1, wherein the alignment structure has a graduated surface descending from the planar top face.

J3. The full-moment column collar of claim J2, wherein the graduated surface is curved.

J4. The full-moment column collar of J2 or J3, wherein the graduated surface is a sloped plane.

J5. The full-moment column collar of any of J-J4, wherein the alignment device is configured to align a lower transverse element of a respective collar flange assembly along a Z-axis and an axis perpendicular to the Z-axis.

J6. The full-moment column collar of any of J-J5, wherein each alignment structure has a positioning surface, each lower transverse element having a machined surface shaped inversely to the positioning surface of a respective alignment structure.

J7. The full-moment column collar of J6, wherein at least a portion of the machined surface is curved.

J8. The full-moment column collar of any of J-J7, wherein each alignment structure is formed out of the respective collar corner assembly.

Advantages, Features, and Benefits

The different examples of the full-moment connection collar systems described herein provide several advantages over known solutions for connecting one or more lateral structural members to a vertical member. For example, illustrative examples described herein allow precise connection of beams to a column in a building frame.

Additionally, and among other benefits, illustrative examples described herein provide precise vertical and horizontal location of lateral members and support during collar connection, with an alignment structure.

Additionally, and among other benefits, illustrative examples described herein minimize assembly steps and time, simplifying collar connection by locating fastening bolts such that a reduced number of bolts can provide desired connection strength.

Additionally, and among other benefits, illustrative examples describe herein provide stabilizing support for lateral structural members during fixing of collar components, with a beam docking structure.

Additionally, and among other benefits, illustrative examples described herein allow production of collar components on-demand from an inventory of blanks for use in building projects with a variety of specifications and dimensional requirements.

Additionally, and among other benefits, illustrative examples described herein provide precise spatial orientation of structural members largely independent of tolerances or other variations in the structure members.

No known system or device can perform these functions, particularly in with such high precision. Thus, the illustrative examples described herein are particularly useful for steel frame building construction. However, not all examples described herein provide the same advantages or the same degree of advantage.

CONCLUSION

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A full-moment column collar, comprising:

four collar flange assemblies, each collar flange assembly including an upper transverse element, a lower transverse element, and a bridging component connecting the upper and lower transverse elements, and four collar corner assemblies, each collar corner assembly including first and second expanses defining a corner and a standoff portion extending from the corner, the standoff portion having a distal T-shaped structure, wherein each collar corner assembly is configured to connect two adjacent collar flange assemblies, and each collar corner assembly has a multi-axis alignment structure extending outwardly from a standoff-facing side surface of the first expanse for vertically positioning a lower transverse element of a respective collar flange assembly.

2. The full-moment column collar of claim 1, wherein the alignment structure has a planar top face configured to contact a bottom surface of a lower transverse element of an adjacent one of the four collar flange assemblies.

3. The full-moment column collar of claim 2, wherein the alignment structure has a graduated surface descending from the planar top face.

4. The full-moment column collar of claim 3, wherein the graduated surface is curved.

5. The full-moment column collar of claim 1, wherein the alignment structure is configured to align a lower transverse element of a respective collar flange assembly along a Z-axis and an axis perpendicular to the Z-axis.

6. The full-moment column collar of claim 1, wherein each alignment structure has a positioning surface, each lower transverse element having a machined surface shaped inversely to the positioning surface of a respective alignment structure.

7. The full-moment column collar of claim 6, wherein at least a portion of the machined surface is curved.

8. The full-moment column collar of claim 1, wherein each alignment structure is formed out of the respective collar corner assembly.

9. The full-moment column collar of claim 1, wherein each collar corner assembly is configured to connect two adjacent collar flange assemblies via two sets of bolts, each set including no more than three bolts.

10. The full-moment column collar of claim 9, wherein the full-moment column collar includes no more than twenty four bolts.

11. The full-moment column collar of claim 1, further including a second multi-axis alignment structure extending outwardly from a standoff-facing side surface of the second expanse.

12. The full-moment column collar of claim 1, wherein the alignment structure has a descending graduated surface.

13. The full-moment column collar of claim 1, wherein the alignment structure has a curved surface.

14. The full-moment column collar of claim 12, wherein each collar flange assembly has a corresponding curved surface.

15. The full-moment column collar of claim 1, wherein the alignment structure has a positioning surface, each lower transverse element having a surface shaped inversely to the positioning surface of a respective alignment structure.

16. The full-moment column collar of claim 1, wherein the alignment structure includes a datum surface for precise vertical location of the respective collar flange assembly.

17. The full-moment column collar of claim 16, wherein the standoff-facing side surface of the first expanse is a datum surface for precise location of the respective collar flange assembly.

18. The full-moment column collar of claim 16, wherein the datum surface of the alignment structure and the standoff-facing side surface of the first expanse are machined surfaces.

19. A full-moment column collar, comprising:

four collar flange assemblies, each collar flange assembly including an upper transverse element, a lower transverse element, and a bridging component connecting the upper and lower transverse elements, and four collar corner assemblies, each collar corner assembly including first and second expanses defining a corner and a standoff portion extending from the corner, the standoff portion having a distal T-shaped structure, wherein:

each collar corner assembly is configured to connect two adjacent collar flange assemblies, each collar corner assembly has a multi-axis alignment structure extending from the first expanse for vertically positioning a lower transverse element of a respective collar flange assembly, and the alignment structure has a positioning surface, each lower transverse element having a surface shaped inversely to the positioning surface of a respective alignment structure.

20. A full-moment column collar, comprising:

four collar flange assemblies, each collar flange assembly including an upper transverse element, a lower transverse element, and a bridging component connecting the upper and lower transverse elements, and four collar corner assemblies, each collar corner assembly including first and second expanses defining a corner and a standoff portion extending from the corner, the standoff portion having a distal T-shaped structure, wherein each collar corner assembly is configured to connect two adjacent collar flange assemblies, and each collar corner assembly has a multi-axis alignment structure extending from a side surface of the first expanse and including a planar surface perpendicular to the side surface, for vertically positioning a lower transverse element of a respective collar flange assembly.

* * * * *